US005836545A

United States Patent [19]

Arlton et al.

[11] Patent Number: 5,836,545

[45] Date of Patent: Nov. 17, 1998

[54] ROTARY WING MODEL AIRCRAFT

[75] Inventors: Paul E. Arlton, 1132 Anthrop Dr., West Lafayette, Ind. 47906; David J. Arlton, West Lafayette; Paul Klusman, Lafayette, both of Ind.

[73] Assignee: Paul E. Arlton, West Lafayette, Ind.

[21] Appl. No.: 728,929

[22] Filed: Oct. 11, 1996

Related U.S. Application Data

[60] Provisional application No. 60/005,344, Oct. 11, 1995.

Related U.S. Application Data

[63] Continuation of Ser. No. 292,718, Aug. 18, 1994, Pat. No. 5,609,312, which is a continuation-in-part of Ser. No. 233, 159, Apr. 25, 1994, Pat. No. 5,628,620, said Ser. No. 728,929, Oct. 11, 1996, is a continuation of Ser. No. 292, 719, Aug. 18, 1994, Pat. No. 5,597,138.

[51] Int. Cl.[6] ..... B64C 27/00; B64D 35/02

[52] U.S. Cl. ..... 244/60; 244/17.11; 446/37; 446/454; 446/457

[58] Field of Search ..... 244/17.11, 17.19, 244/17.21, 60, 190; 446/36, 37, 57, 454, 456, 457

[56] References Cited

U.S. PATENT DOCUMENTS

| | | | |
|---|---|---|---|
| 2,384,516 | 9/1945 | Young . | |
| 2,689,099 | 9/1954 | Lightfoot . | |
| 3,004,736 | 10/1961 | Culver et al. . | |
| 3,027,948 | 4/1962 | Goland et al. . | |
| 3,127,696 | 4/1964 | Pagliuso . | |
| 3,144,223 | 8/1964 | Nichols . | |
| 3,211,235 | 10/1965 | Bretl . | |
| 3,528,633 | 9/1970 | Knemeyer . | |
| 3,532,302 | 10/1970 | Dean . | |
| 3,784,174 | 1/1974 | Tarnofsky | 244/190 |
| 4,109,549 | 8/1978 | Vincent | 244/60 |
| 4,249,711 | 2/1981 | Godbersen | 244/54 |
| 4,270,711 | 6/1981 | Cresap et al. . | |
| 4,272,041 | 6/1981 | Mabuchi et al. . | |
| 4,579,301 | 4/1986 | Brand . | |
| 4,706,907 | 11/1987 | Kopylov . | |
| 4,759,514 | 7/1988 | Burkam . | |
| 5,037,041 | 8/1991 | Unterhitzenberger . | |
| 5,301,900 | 4/1994 | Groen et al. . | |
| 5,358,201 | 10/1994 | Brown, Sr. . | |
| 5,381,988 | 1/1995 | Kattas . | |
| 5,505,423 | 4/1996 | Kusijanovic | 446/57 |
| 5,609,312 | 3/1997 | Arlton et al. | 244/17.19 |

FOREIGN PATENT DOCUMENTS

| | | | |
|---|---|---|---|
| 23 32 991 | 1/1974 | Germany | 446/36 |
| 4-31197 | 2/1992 | Japan . | |
| 1 205 263 | 9/1970 | United Kingdom | 244/17.17 |

OTHER PUBLICATIONS

Schulter's Radio Controlled helicopter Manual, by Dieter Schluter, 1986, cover page, pp. 82, 84, 104, 105, 232, and 233.

Brochure on Miniature Aircraft USA XL–PRO Graphite X–Cell, three pages, 1995.

Brochure on the X–Cell .30 and .40 Standard Features, no date, two pages.

(List continued on next page.)

*Primary Examiner*—Virna Lissi Mojica
*Attorney, Agent, or Firm*—Barnes & Thornburg

[57] ABSTRACT

A model rotary wing aircraft is provided that includes a fuselage, a power plant, a main rotor, a tail rotor, and a drive apparatus. The power plant includes a passive cooling system to transfer heat produced by the power plant to the atmosphere. The passive cooling system consumes less than about five percent of the power produced by the power plant. The main rotor is driven by the power plant at a main rotor speed of rotation and the tail rotor is driven by the power plant at a tail rotor speed of rotation. The drive apparatus transfers power from the power plant to the main rotor and tail rotor to rotate the tail rotor at a tail rotor speed of rotation that is about three times greater than the main rotor speed of rotation to minimize the amount of power used by the tail rotor.

50 Claims, 24 Drawing Sheets

OTHER PUBLICATIONS

Sales brochure for the HLA444 Hobby Lobby/MFA Sport 500 Collective, Mark 2 contained in the Nov. 1994 Model Airplane News.

Sales brochure for the HLA400 Hobby Lobby/MFA Sport 500 Helicopter contained in the Jan. 1990 Model Aviation sales catalog, p. 163, in the Hobby Lobby International, Inc. advertisement section.

Assembly Instruction Manual for Cricket R/C Helicopters produced by Gorham Model Products, Inc. Five pages. Date unknown.

Building Plans for Enforcer ZR produced by Kalt Helicopters. One page. Date unknown.

"Rotory Debut: Great Planes Concept 10", *Rotory Modeler,* May 1992, p. 33.

"Rotory Debut: New Push/Pull System from TSK", *Rotory Modeler,* May, 1992, p. 69.

Sales brochure for GMP's New World Class Contest Helicopter Series contained in GMP's 1989 catalogue. Two pages.

Sales brochure for GMP Legend Series contained in GMP's 1990 catalogue, p. 7 and cover page.

Building Plans for the Champion Model Helicopter, (No. 3800), produced by Schluter. Three pages. Date unknown.

Sales brochure for Concept 60SR produced by Kyosho Corporation. One page. Date unknown.

Basic Assembly Manual for Rebel Helicopter produced by Gorham Model Products, Inc. Sixteen pages. Aug., 1989.

Instruction Manual, general information, and Building Plans for XL–PRO Graphite X–Cell by Miniature Aircraft U.S.A. Five pages. Date unknown.

Building plans for XL–PRO produced by Miniature Aircraft U.S.A. Two pages. 1994.

Information concerning the Whisper Electric Helicopter distributed by Hobby Dynamics Distributors, *Rotory Modeler,* p. 54, date unknown and sales brochure, two pages, date unknown.

Hobby Lobby International, Inc. video showing Sport 500 Helicopter and Hughes 500 Electric Helicopter.

Sales brochure for X–Cell Gas produced by Nick Sacco. One page. Date unknown.

Rock, Gene, *SSP–5, American Aircraft Modeler,* Mar., 1973, pp. 41–45 and 76–79.

*R/C Feel Out the Helicopter A to Z,* two page sales brochure for model helicopters produced by Kyosho Co. of Kanagawa Pretecture. Date unknown. Illustrations in brochure show the structure of the helicopter including the main rotor, tail rotor, frame, and landing gear.

Information concerning the Graupner Heim helicopter contained in *Neuheiten* '91, pp. 22–23. lllustrations show the structure of the helicopter including the main rotor, frame, and landing gear.

Building Instructions for the Champion model helicopter produced by Hubschrauber Schluter. Two pages. Date unknown. Plan order 3801.

Building Plans for X–Cell thirty and forty series model helicopter produced by Miniature Aircraft USA 1989, two pages.

Sales brochure for the Petit Helicopter, Sports Flight Helicopter, and helicopter accessories contained in the sales for Hirobo Limited. Three pages. Date unknown.

Sales brochure for the Whisper Electric helicopter distributed by Hobby Dynamics Distributors. One page. Date unknown.

*Rotary Modeler,* May/Jun., 1992. One page.

"Product News", AME. 049 Glow Engine, Model Airplane News, Aug. 1994, p. 131.

O. S. Heli Power advertisement in Model Airplane News, May 1992.

O. S. Engines advertisement in Model Airplane News, Nov. 1992.

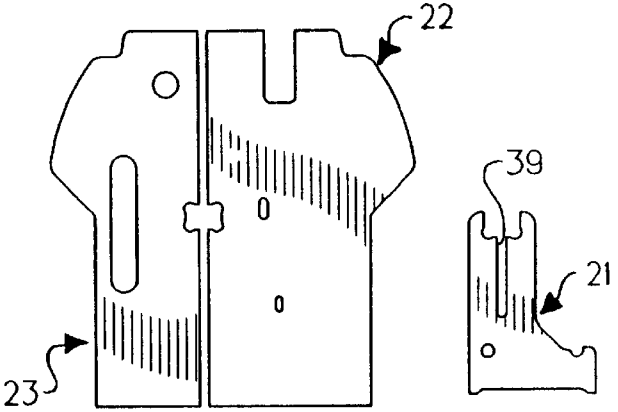
Fig. 3F
Fig. 3E
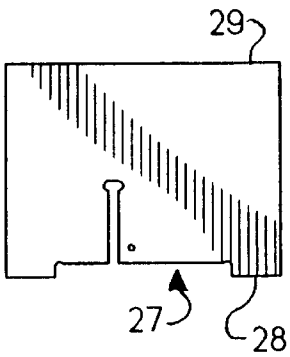
Fig. 3B
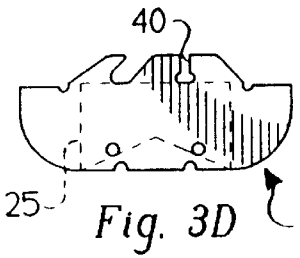
Fig. 3D
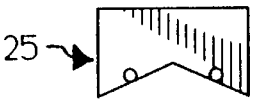
Fig. 3C
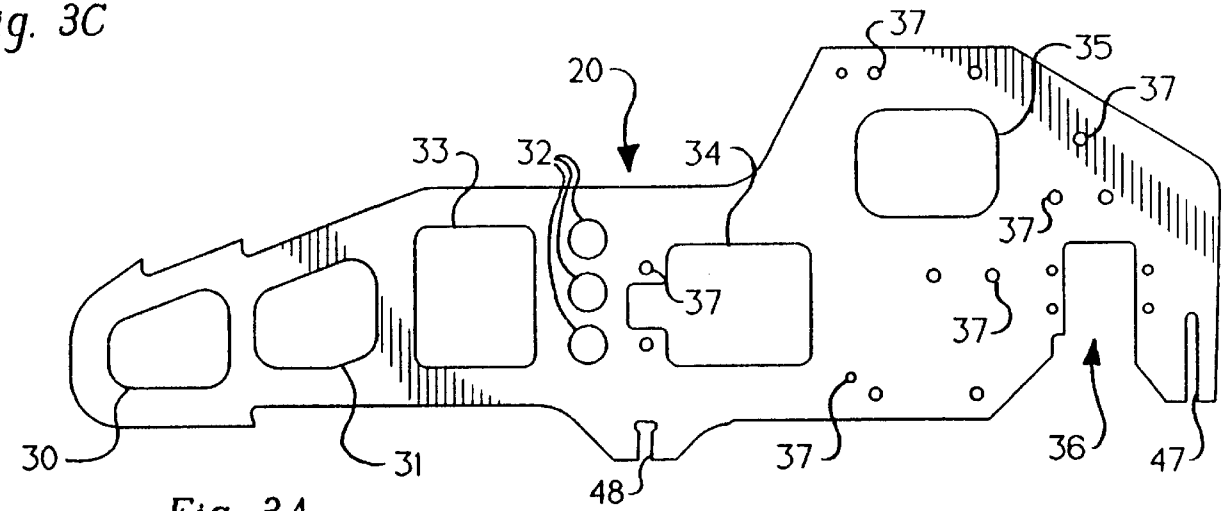
Fig. 3A

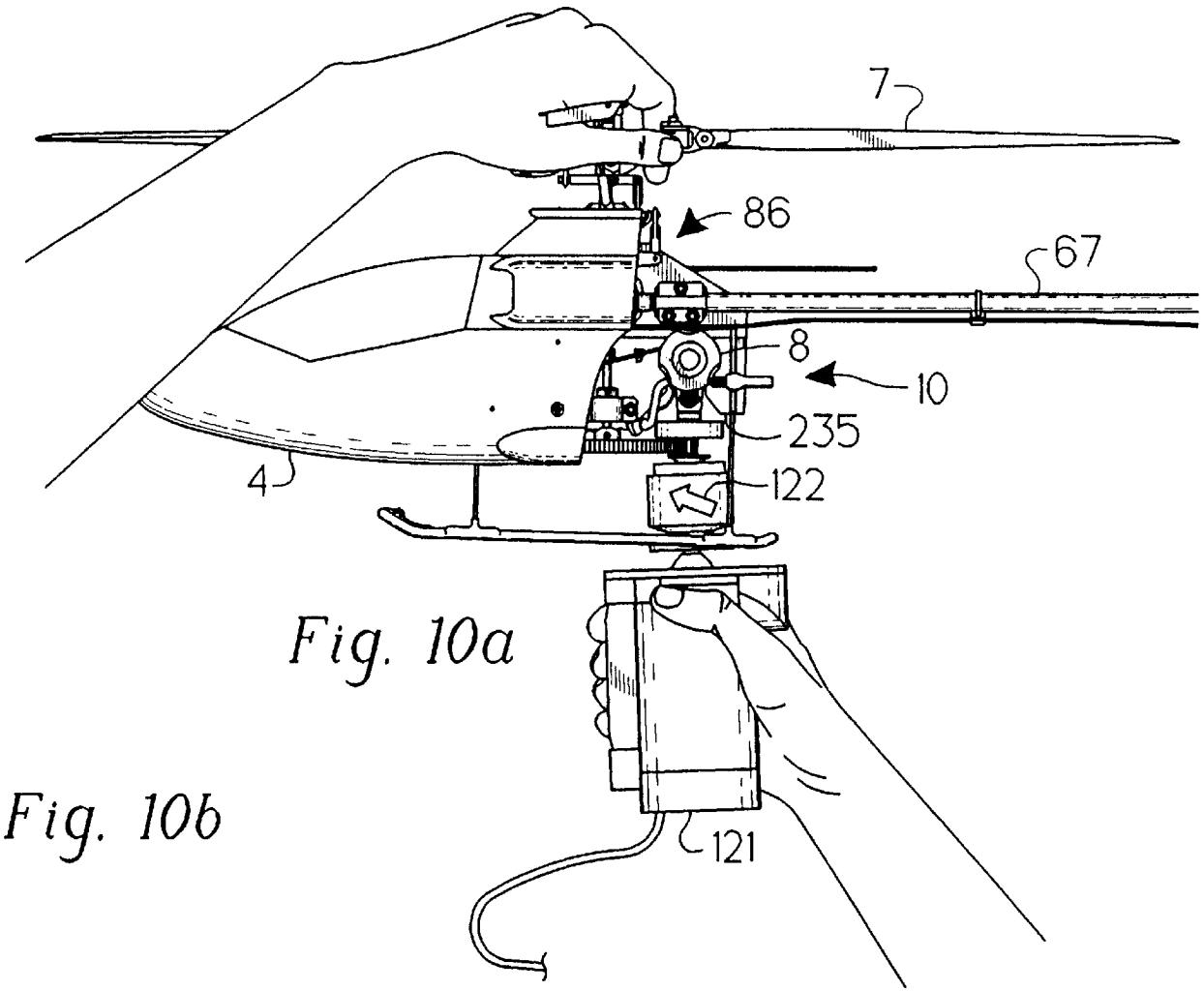
Fig. 10a
Fig. 10b
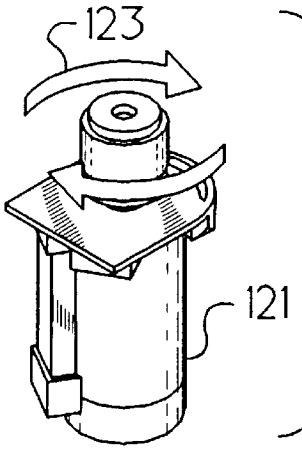

ROTARY WING MODEL AIRCRAFT

This patent application is a continuation of U.S. patent application Ser. No. 08/292,718, filed Aug. 18, 1994, by Paul E. Arlton, David J. Arlton now U.S. Pat. No. 5,609312, and Paul Klusman, which is a continuation-in-part of U.S. patent application Ser. No. 08/233,159, filed Apr. 25, 1994, by Paul E. Arlton and David J. Arlton, now U.S. Pat. No. 5,628,620. U.S. patent application Ser. No. 8/728,929, filed Oct. 11, 1996. This patent application is also a continuation o U.S. patent application Ser. No. 08/292,719, filed Aug. 18, 1994, by Paul E. Arlton and David J. Arlton, now U.S. Pat. No. 5,597,588. This patent application also claims priority to U.S. provisional patent application Ser. No. 60/005,344, filed Oct. 11, 1995, by Paul E. Arlton, David J. Arlton, and Paul Klusman.

BACKGROUND AND SUMMARY OF THE INVENTION

This invention relates to engine-powered rotary wing model aircraft including model helicopters and, in particular, to a remote-controlled rotary wing model aircraft having an engine, main rotor, a tail rotor, and an engine cooling system. More particularly, this invention relates to the distribution and allocation of engine power to various rotor systems included in a flying, radio-controlled, rotary wing model aircraft.

In general, helicopters are flying machines with the ability to hover and fly forwards, backwards, and sideways. With all of their spinning mechanisms and mechanical linkages, helicopters are intrinsically interesting. It is little wonder that aviation buffs have always taken special interest in model helicopters.

While some model helicopters are used for serious work such as for military surveillance, by far the widest use of remote-controlled model helicopters is for recreation—to be built and flown as a hobby. For the widest appeal, the ideal model helicopter should accommodate the needs of the average hobbyist. First and foremost, hobbyists want a helicopter that flies. They also want a machine they can understand and operate without undue effort and expense. They also need a durable machine because piloting a model helicopter requires substantial hand-eye coordination and motor skill, and most novice pilots crash their models frequently when learning to fly. For all of these reasons, features that increase durability and flight performance and reduce cost and complexity are very valuable.

The first practical radio-controlled model helicopters flew in about 1969. Since then, designers have endeavored to develop model helicopters that fly better and cost less. After decades of development, however, model helicopter designs have stagnated. Designers tend to follow the lead of other designers and many so-called "breakthrough" features are merely gimmicks developed for reasons of marketing rather than functionality. Model helicopter designers, who are more often hobbyists than professional engineers, frequently fail to consider the differences between large-scale and small-scale structures and aerodynamics and base their model designs on full-size helicopters. Most commercially successful large model helicopters typically require large engines producing 1 to 2 horsepower (746 to 1492 watts). When scaled down to model proportions, their small rotor systems are typically so inefficient at producing lift that many small helicopters can hardly get off the ground.

What is needed is a rotary wing model aircraft having a power distribution system that efficiently distributes engine power produced by an engine to components of the rotary wing model aircraft that require engine power so that a maximum amount of engine power is allocated to a main rotor system to provide the rotary wing model aircraft with maximum lift. The components that require power other than the main rotor system are a tail rotor system, an engine cooling system, and mechanical power transmission components. The tail rotor system and engine cooling system are configured to use a minimum amount of power so that a maximum amount of engine power is allocated to the main rotor system to provide the rotary wing model aircraft with maximum lift.

According to the present invention, a rotary wing model aircraft is provided. The model rotary wing aircraft includes a fuselage, a main rotor system connected to the fuselage to provide lift for the rotary wing model aircraft, and a tail rotor system linked to the fuselage to stabilize the rotary wing model aircraft. The rotary wing model aircraft further includes an engine that produces engine power and a power transmission system to distribute the engine power to the tail rotor system and the main rotor system. The engine is connected to the fuselage. The power distribution system, in accordance with the present invention, distributes about 10% of the engine power produced by the engine to the tail rotor system and about 90% of the engine power produced by the engine to the main rotor system and drive train components so that a maximum amount of engine power is distributed to the main rotor system to produce a maximum amount of lift for the rotary wing model aircraft.

Small model helicopters in accordance with the present invention fly well on 1/100th to 1/20th of the horsepower of conventional large model helicopters by virtue of efficient power allocation between the main rotor, tail rotor, and engine cooling system. The engine cooling system and tail rotor system are configured in a manner to use a minimum amount of power so that more power can be allocated to the main rotor system to produce more lift. The main rotor system is configured to generate a maximum amount of lift-force per unit of power so that more lift can be produced.

To minimize engine power used by the tail rotor, the diameter of the tail rotor is substantially larger than the tail rotors of conventional model helicopters. In addition, the tail rotor minimizes engine power used by slowing the speed at which the tail rotor rotates relative to the main rotor as compared with tail rotors of conventional radio controlled model helicopters.

The engine cooling system minimizes power by using a passive cooling heat sink that is directly connected to the engine. When the heat sink is used in combination with the larger and slower tail rotor, a substantially higher percentage of engine power is available to drive the main rotor system than is available on conventional model helicopters.

Engine power as used herein is the rate of rotation of the engine output shaft about its axis of rotation multiplied by the torque produced by the engine output shaft. Engine power can be expressed in units such as watts, horsepower, or foot-pound/second.

Additional objectives, features, and advantages of the invention will become apparent to those skilled in the art upon consideration of the following detailed description of preferred embodiments which illustrate the best mode for carrying out the invention as presently perceived.

BRIEF DESCRIPTION OF THE DRAWINGS

The detailed description particularly refers to the accompanying figures in which:

FIG. 3*a* is a side elevation view of the elongated, flat keel included in the model helicopter of FIGS. 1 and 2 showing various slots and apertures formed in the keel for holding various helicopter radio, control, and drive train components;

FIGS. 3*b*–3*f* are views of various pieces that mount onto the keel to support the canopy and the landing gear in the manner shown in FIGS. 2 and 5;

FIG. 3*b* is a plan view of a floor that attaches to a bottom side of the keel;

FIG. 3*c* is a side elevation view of a bulkhead reinforcement;

FIG. 3*d* is a side elevation view of a landing gear bulkhead that attaches to the bottom side of the keel and showing (in phantom) where the bulkhead reinforcement shown in FIG. 3*c* is appended to the landing gear bulkhead;

FIG. 3*e* is a side elevation view of first and second bulkhead fire walls that are mounted to opposite sides of the elongated, flat keel and are positioned to lie at the rear edge of the canopy and adjacent to the model helicopter engine;

FIG. 3*f* is a side elevation view of a landing gear bracket that attaches to the bottom side of the elongated, flat keel;

Fig. 10*a* is a side elevational view of the present invention showing application of an electric handheld starting motor to an engine starter cone to start the model helicopter engine;

Fig. 10*b* is a perspective view of the electric hand-held starting motor;

FIGS. 20*a*–*h* are views of a main rotor blade in accordance with the present invention with details of airfoiled cross sections shown for several span-wise stations illustrating the relative thickness, camber, and pitch of the airfoiled cross sections;

DETAILED DESCRIPTION OF THE DRAWINQS

Figure 1:
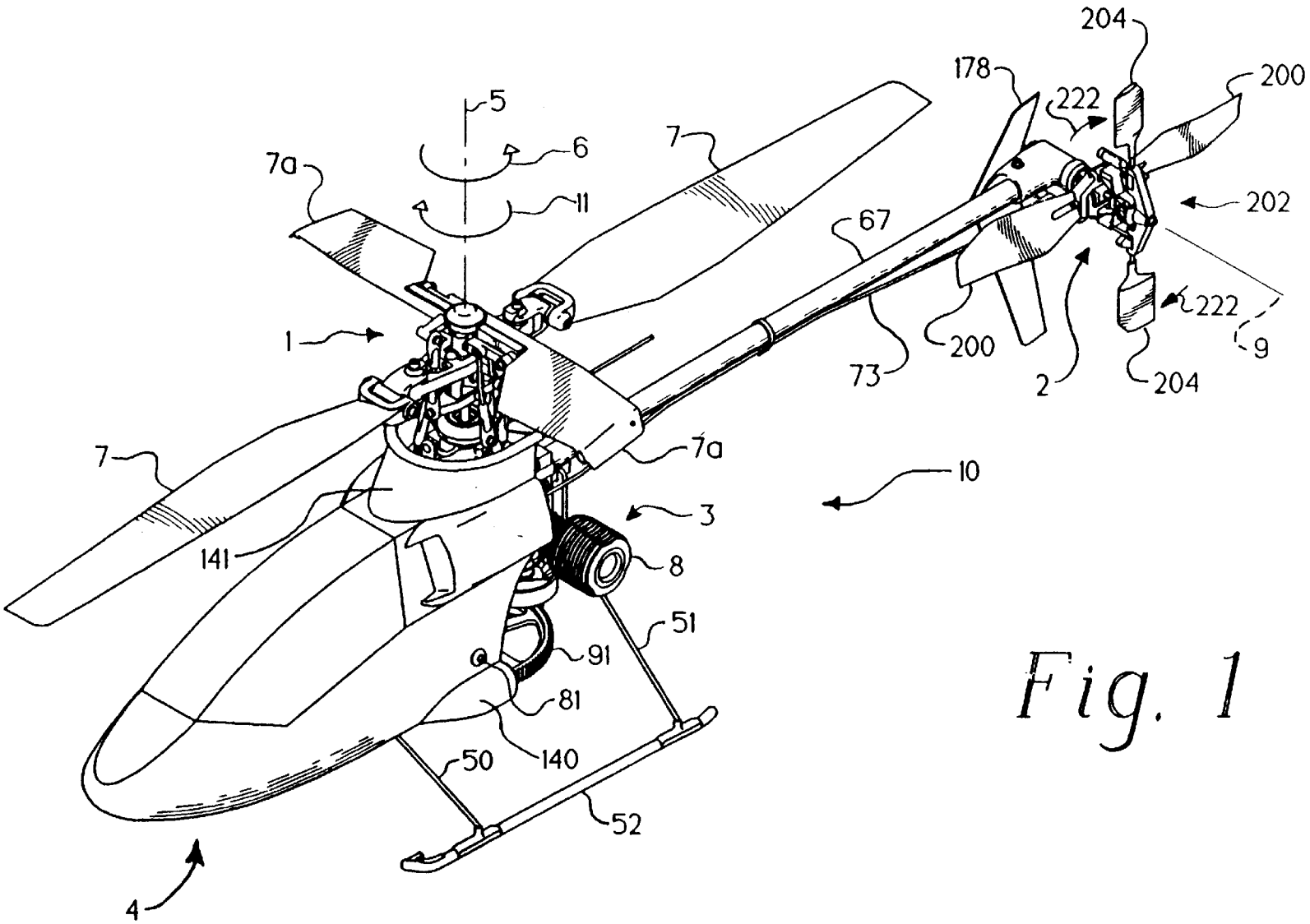
FIG. 1 is a perspective view of a model helicopter in accordance with the present invention showing a main rotor, tail rotor mounted at one end of the tail boom, canopy, and landing gear.

A model helicopter 10 in accordance with the present invention is shown in FIG. 1. Model helicopter 10 is commonly designed to include large main rotor 1 which rotates about main rotor axis 5 to lift helicopter 10 into the air and smaller tail rotor 2 which rotates about tail rotor axis 9 to counteract torque produced by main rotor 1 and steer helicopter 10. Illustratively, main rotor 1 includes a pair of main rotor blades 7 and a pair of shorter stabilizing rotor blades 7*a,* and tail rotor 2 includes a pair of tail rotor blades 200. A mechanical gyro stabilizer 202 including a pair of aerodynamic gyro paddles 204 is mounted on tail rotor 2 as shown in FIG. 1.

Figure 2:
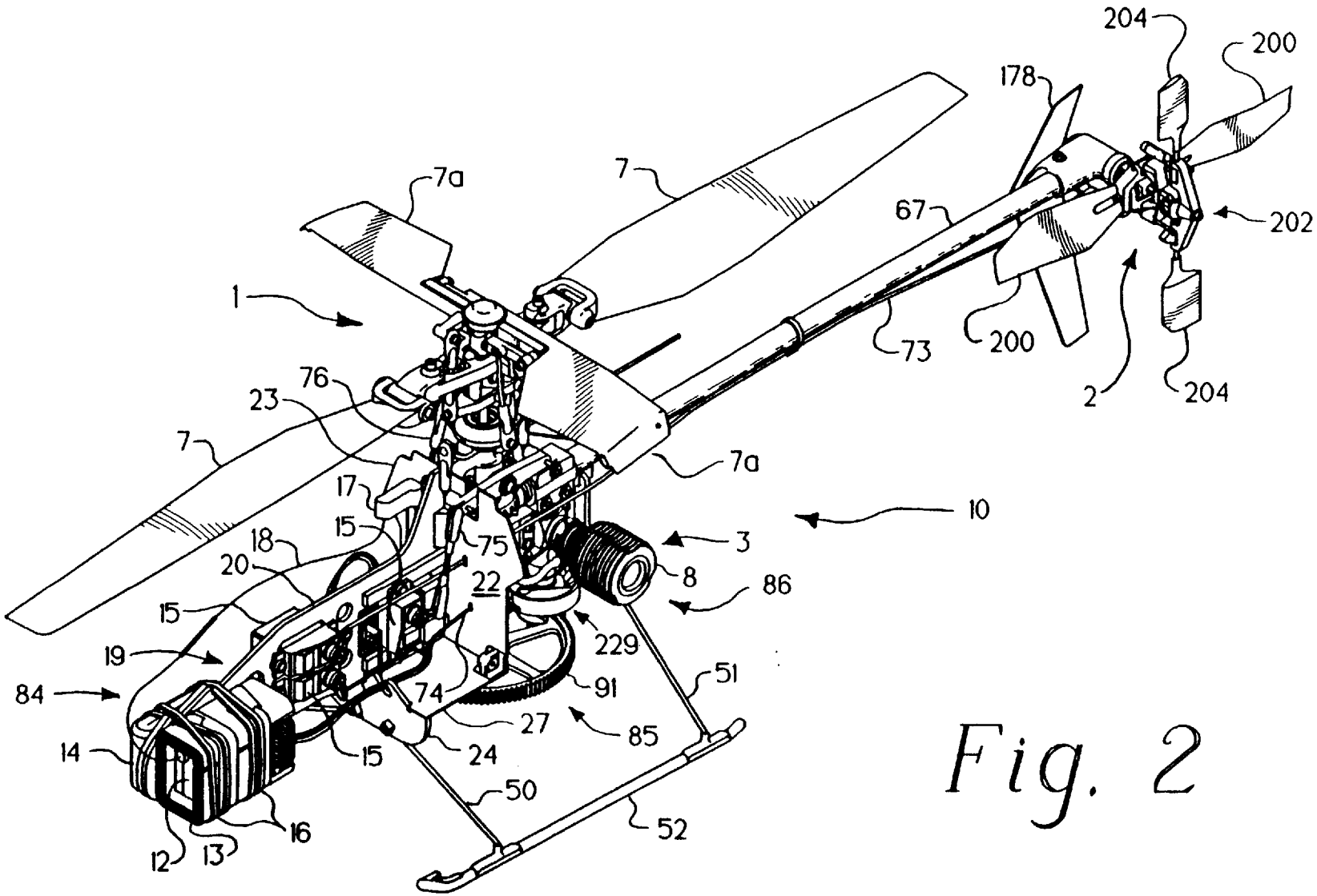
FIG. 2 is a perspective view of the model helicopter shown in FIG. 1 with the canopy removed to show a fuselage including an elongated, flat, vertically oriented keel having radio-control and servo-control elements appended to it.

Tail rotor 2 is mounted at a rear end of tail boom 67 as shown in FIGS. 1 and 2. Both main rotor 1 and tail rotor 2 are driven by an engine 3 usually located within the helicopter fuselage (body) near the vertical main rotor shaft. A detailed description of suitable helicopter main rotor systems are disclosed in U.S. patent application Ser. No. 08/233,159 filed Apr. 25, 1994 by Paul E. Arlton and David J. Arlton, and a U.S. Patent Application "Main Rotor System For Model Helicopters" filed on Oct. 11, 1996 by Paul E. Arlton and David J. Arlton, which are hereby incorporated by reference herein. A detailed description of suitable tail rotor systems are disclosed in U.S. Pat. No. 5,305,968 to Paul E. Arlton, U.S. patent application Ser. No. 08/292,719, filed Aug. 18, 1994 by Paul E. Arlton and David J. Arlton, and U.S. patent application Ser. No. 08/687,649 filed Jul. 26, 1996 by Paul E. Arlton, which are hereby incorporated by reference herein.

Figure 6:
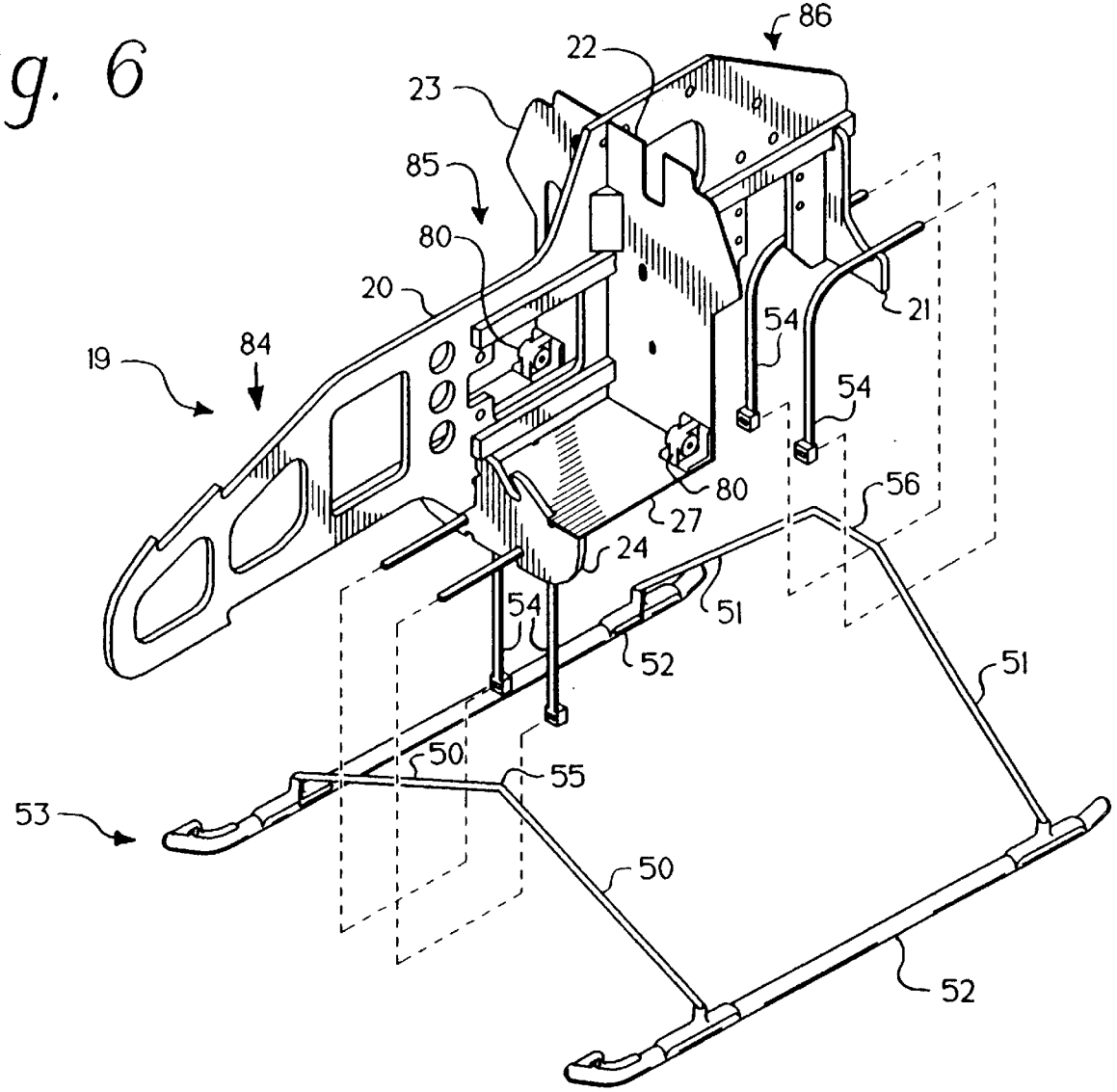
FIG. 6 is an exploded perspective view of the keel and canopy-supporting and landing gear-supporting fuselage structural elements mounted on the keel showing the attachment of the landing gear elements to the landing gear-supporting portion of the fuselage, with all other parts of the helicopter removed for clarity.

A streamlined canopy 4 covers a front portion of helicopter 10 and includes a body 139, gear shroud 140, and main rotor shroud 141 as shown in FIGS. 1 and 6. A radio-controlled command unit and other drive mechanisms are contained inside canopy 4 as shown in FIG. 2. Canopy 4 is designed for use on a model helicopter such as helicopter 10 to protect the radio-control unit and provide the appearance of a pilot-carrying portion of helicopter 10. Canopy 4 does not extend back to tail rotor 2 on some helicopters 10. When sitting on the ground, helicopter 10 is supported by front landing gear struts 50 and rear landing gear struts 51 attached to spaced-apart skids 52 with one skid 52 positioned on each side of helicopter 10.

In operation, main rotor 1 rotates rapidly about main rotor axis 5 in rotation direction 6. As main rotor 1 rotates, main rotor blades 7 act like propellers or fans moving large amounts of air downward thereby creating a force that lifts helicopter 10 upward. The torque. (reaction force) created by rotating main rotor 1 in rotation direction 6 tends to cause the body of helicopter 10 to swing about main rotor axis 5 in direction 11 as shown in FIG. 1. When trimmed for steady hovering flight, tail rotor 2 creates enough thrust force to cancel the torque produced by main rotor 1 so that helicopter 10 can maintain a constant heading. Decreasing or increasing the thrust force of tail-rotor 2 causes helicopter 10 to turn (rotate about axis 5) in the desired direction.

A-helicopter 10 with canopy 4 removed revealing radio system components used to control main rotor 1, tail rotor 2, and engine 3 is shown in FIG. 2. To control model helicopter 10, a pilot manipulates small joysticks on a hand-held radio transmitter (not shown) to send commands to radio receiver 12 through antenna 17 and antenna wire 18.

Radio receiver 12 is usually wrapped in vibration-absorbing foam 13. Radio receiver 12 relays these commands to electromechanical servo actuators 15 (hereinafter called servos) to control main rotor 1, tail rotor 2, and engine 3. Battery 14 provides the electrical power necessary to operate radio receiver 12 and servos 15. Rubber bands 16 encircle battery 14 and receiver 12 and secure them to helicopter 10.

Figure 7:
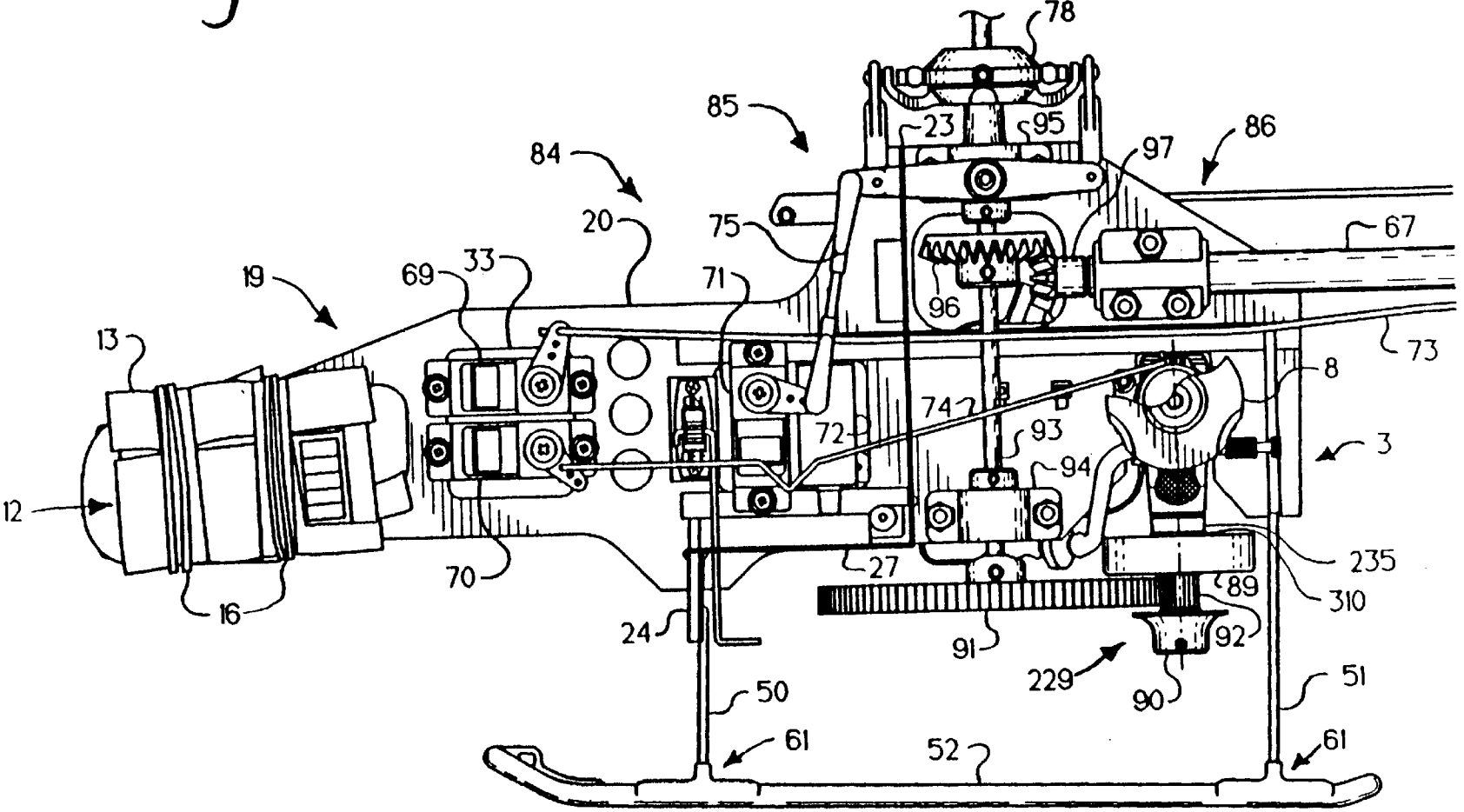
FIG. 7 is a left side elevation view of the model helicopter of FIGS. 1 and 2 showing the elongated, flat, vertical keel and relative positions of radio system components, drive train components and structural components along with the vertical main rotor shaft, horizontal tail boom, and landing gear wherein the engine heat sink is shown in partial cutaway to expose throttle pushrod detail and electrical wiring between radio components is omitted for clarity.
Figure 8:
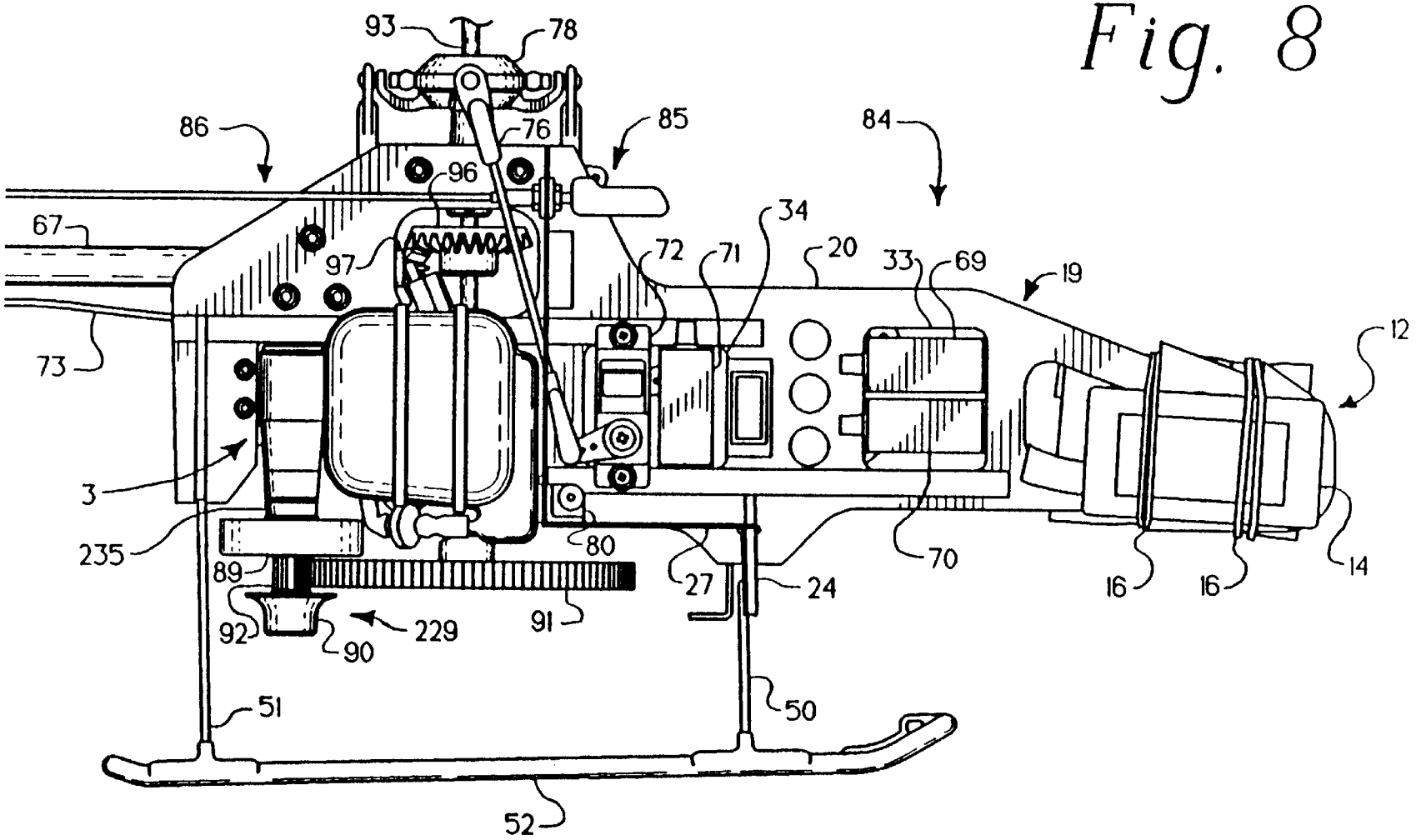
FIG. 8 is a right side elevational view of the model helicopter of FIGS. 1 and 2 showing relative positions of radio system components, drive train components, structural components, and fuel system components, wherein electrical wiring between radio components is omitted for clarity and landing gear attachment detail is also removed for clarity.
Figure 9:
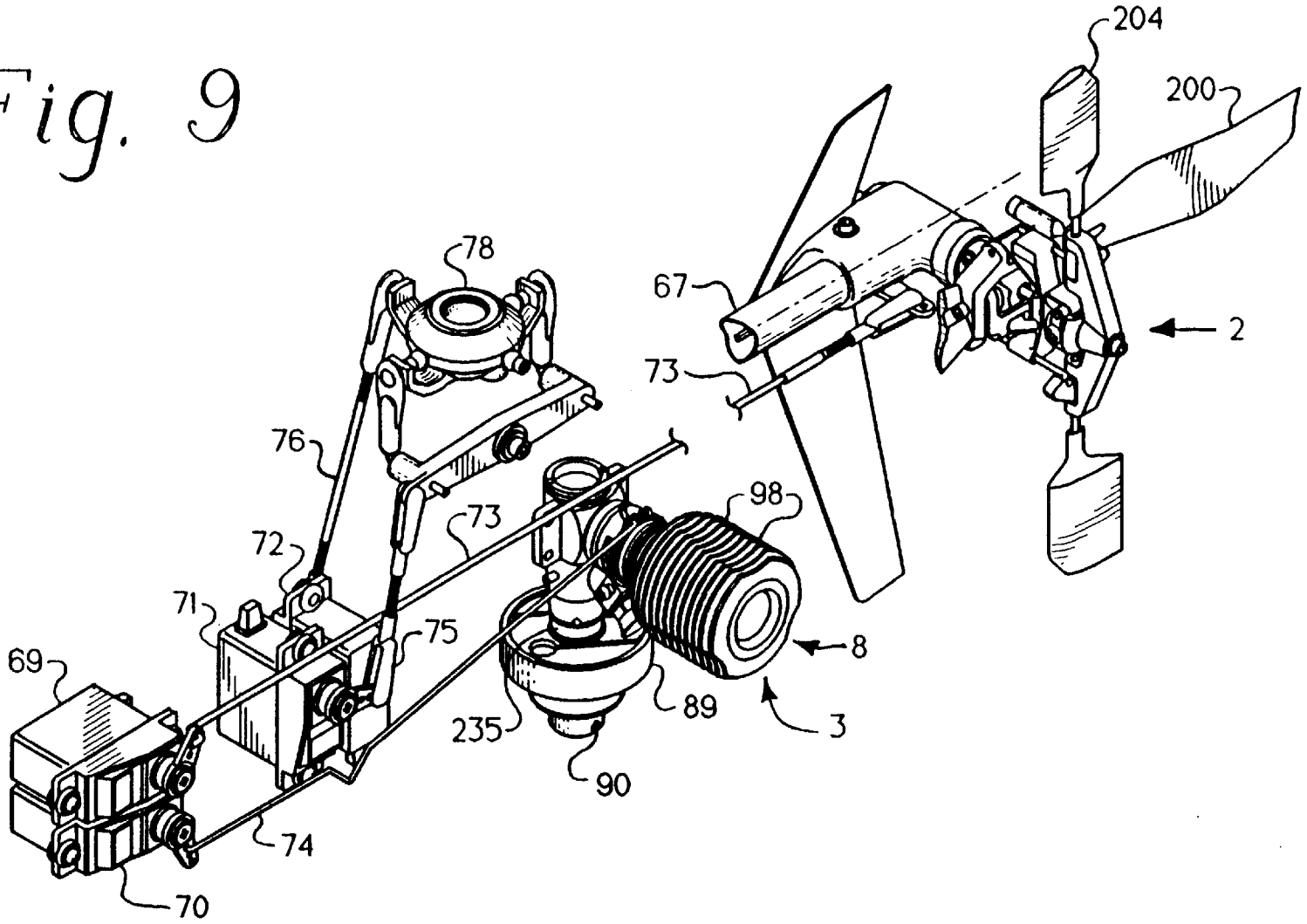
FIG. 9 is a perspective view of a linkage system in accordance with the present invention showing elements of the radio system, swashplate (main rotor head control system), engine, and tail rotor, with all structural elements removed for clarity.
Figure 11:
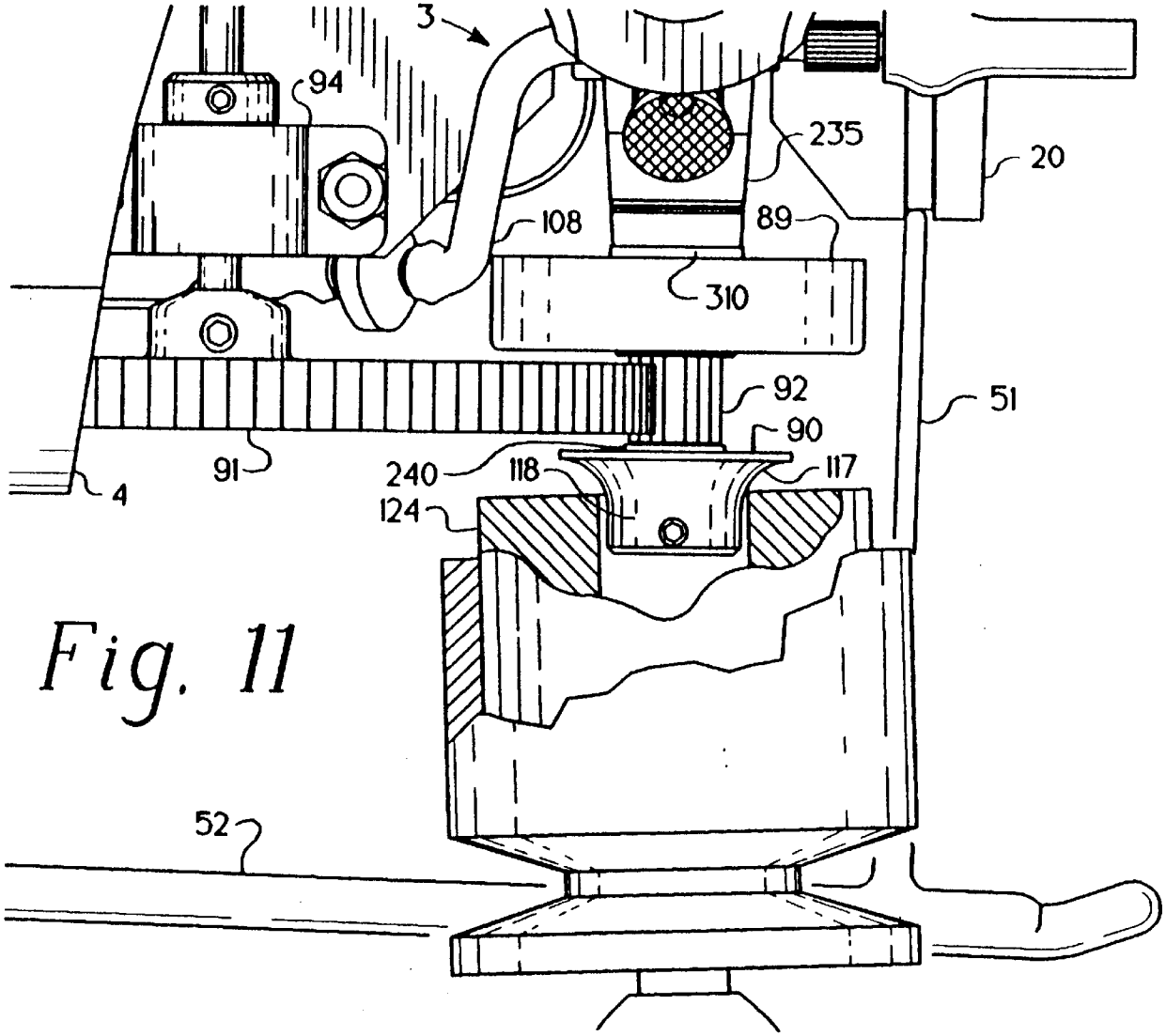
FIG. 11 is an enlarged side elevation view of a portion of the model helicopter shown in FIG. 10*a,* with starter motor elements shown in cut-away, and a landing gear strut and skid removed for clarity.
Figure 12:
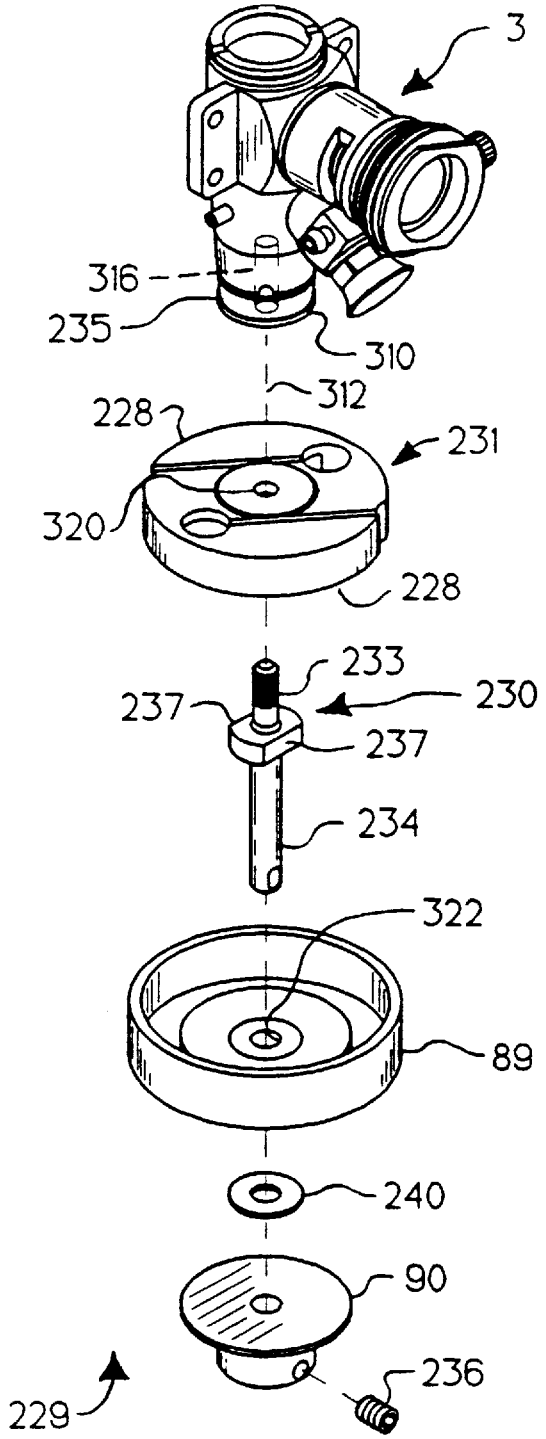
FIG. 12 is an exploded perspective view of a preferred engine and clutch assembly of the present invention.
Figure 12A:
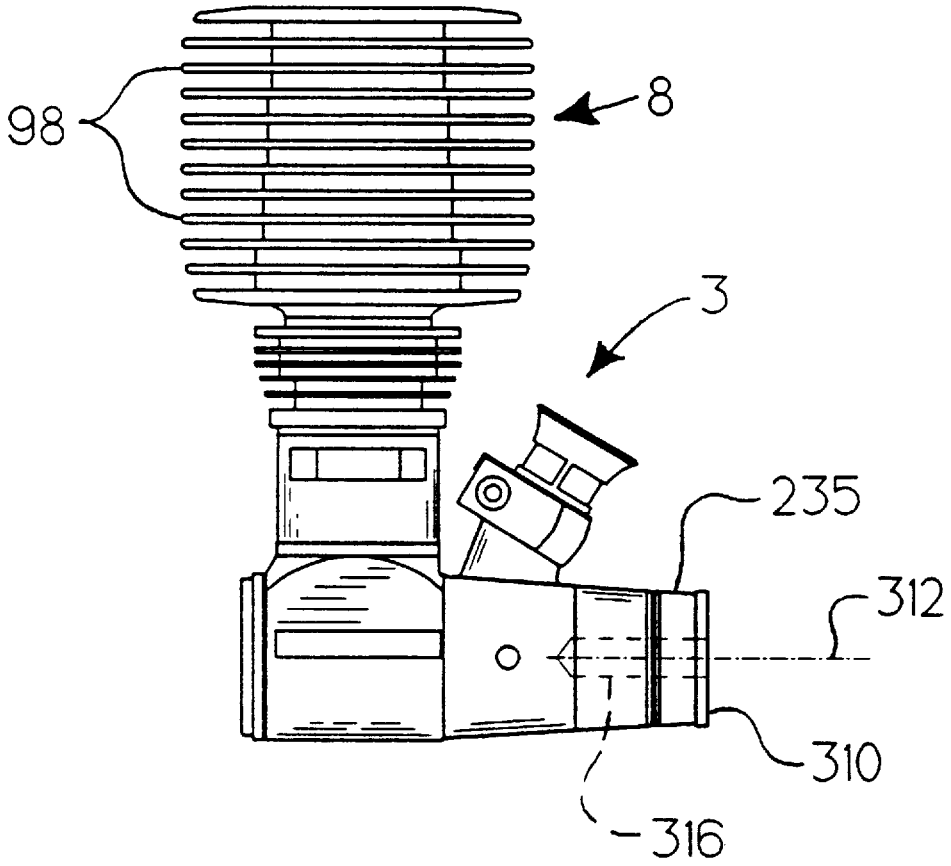
FIG. 12*a* is a side elevational view of the engine.
Figure 13A:
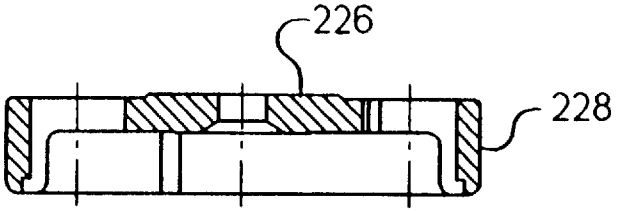
FIGS. 13*a* is a side elevation view shown in cross-section of a preferred one-piece clutch shoe in accordance with the power transmission system of the current invention.
Figure 13B:
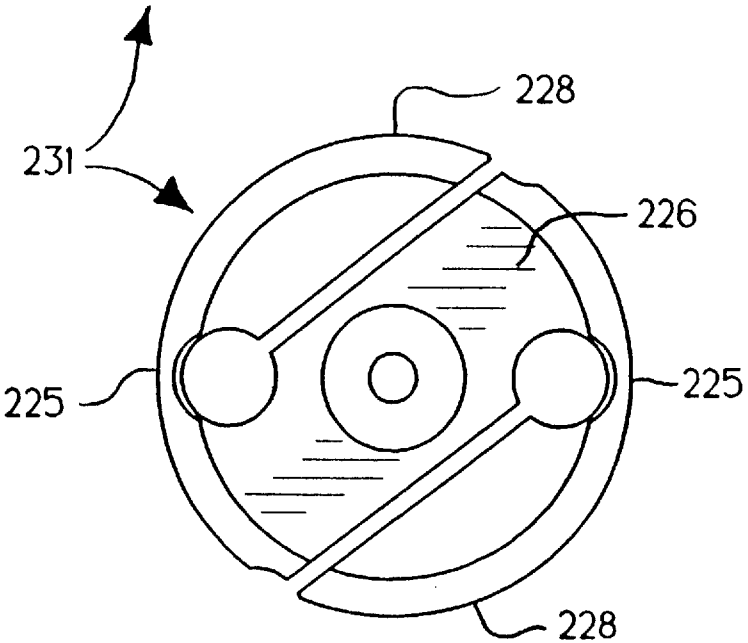
FIGS. 13*b* is an end view of a preferred one-piece clutch shoe in accordance with the power transmission system of the current invention.
Figure 14A:
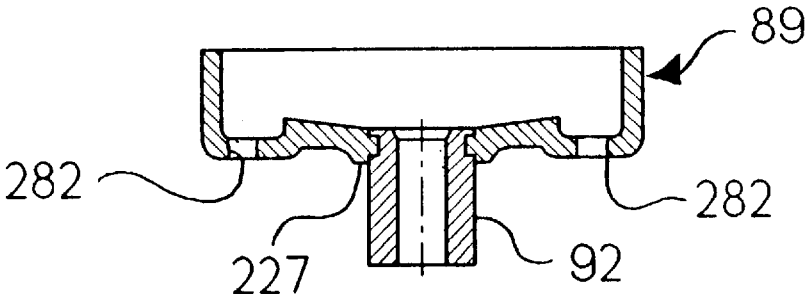
FIGS. 14*a* is a side elevation view shown in cross-section of a preferred clutch bell in accordance with the power transmission system of the current invention.
Figure 14B:
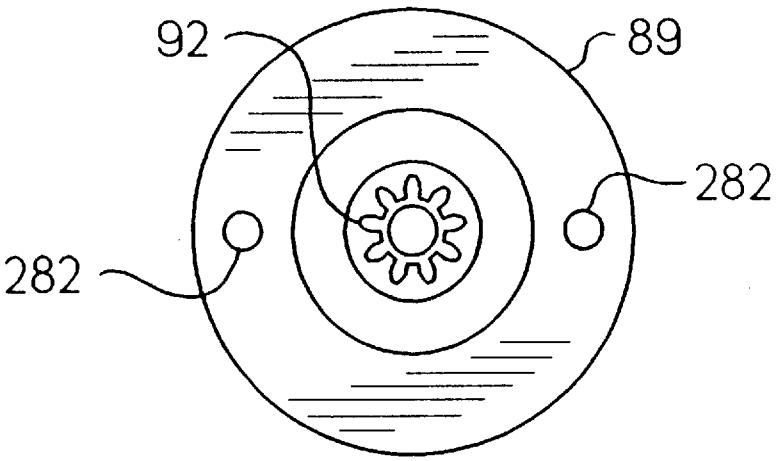
FIGS. 14*b* is an end view of a preferred clutch bell in accordance with the power transmission system of the current invention.

The four basic control functions required to fly a model helicopter 10 (fore-aft cyclic, right-left cyclic, tail rotor 2, and throttle/collective) each require a separate servo 15. Push-pull rods 73–76 and bellcranks 145 connect servos 15 to main rotor 1, tail rotor 2 and engine 3. Fore-aft cyclic servo 71 and right-left cyclic servo 72 control main rotor 1 and cause helicopter 10 to tilt forward or backward, and right or left respectively as shown in FIGS. 7–9. Tail rotor servo 69 causes helicopter 10 to rotate about rotation axis 5 in the same way a steering wheel turns a car. Throttle/collective servo 70 controls the altitude and speed of helicopter 10 by adjusting the speed of engine 3 and/or the pitch of main rotor blades 7.

Fuselage 19 forms the structural backbone of helicopter 10. All mechanical and electronic systems of helicopter 10 are mounted to and almost completely obscure fuselage 19 as shown in FIG. 2. Fuselage 19 includes forward section or portion 84 supporting radio receiver 12 and servos 15, middle section or portion 85 having the canopy support frame, and rear section or portion 86 supporting engine 3. To better understand the fuselage structure of helicopter 10, it is easiest to look at individual pieces of fuselage 19 separated from the rest of helicopter 10. A detailed description of a model helicopter fuselage structure that may be employed with the current invention is disclosed by Paul E. Arlton et. al. in U.S. patent application Ser. No. 08/292,718, filed Aug. 18, 1994, which is hereby incorporated herein by this reference.

FIGS. 3*a*–3*f* show fuselage 19 structural elements comprising keel 20, landing gear bracket 21, fire wall left and right halves 22 and 23, landing gear bulkhead 24, bulkhead reinforcement 25, and floor 27. Floor 27 includes a forward end 28 facing toward the front section 84 of keel 20 and a rearward end 29 facing toward the rear section 86. Keel 20 is formed to include several apertures to reduce the weight of helicopter 10 and accommodate various mechanical and electronic system components. More specifically, keel 20 is formed to include weight-reduction holes 30, 31, and 32; servo bays 33 and 34; gear-clearance hole 35; engine cutout 36; and multiple bolt and alignment holes 37.

Bulkhead reinforcement 25 shown in FIG. 3c is glued to and reinforces bulkhead 24 as shown in phantom in FIG. 3*d*. In preferred embodiments of the present invention, all structural elements of fuselage 19 shown in FIG. 3 are made of aircraft-grade plywood. Keel 20, landing gear bracket 21, and landing gear bulkhead 24 are approximately three times as thick as the remaining elements to carry higher structural loads. In alternative embodiments of the present invention, shown for instance in FIGS. 15 and 16, composite materials such as fiber-reinforced plastics could be substituted for plywood.

Figure 4:
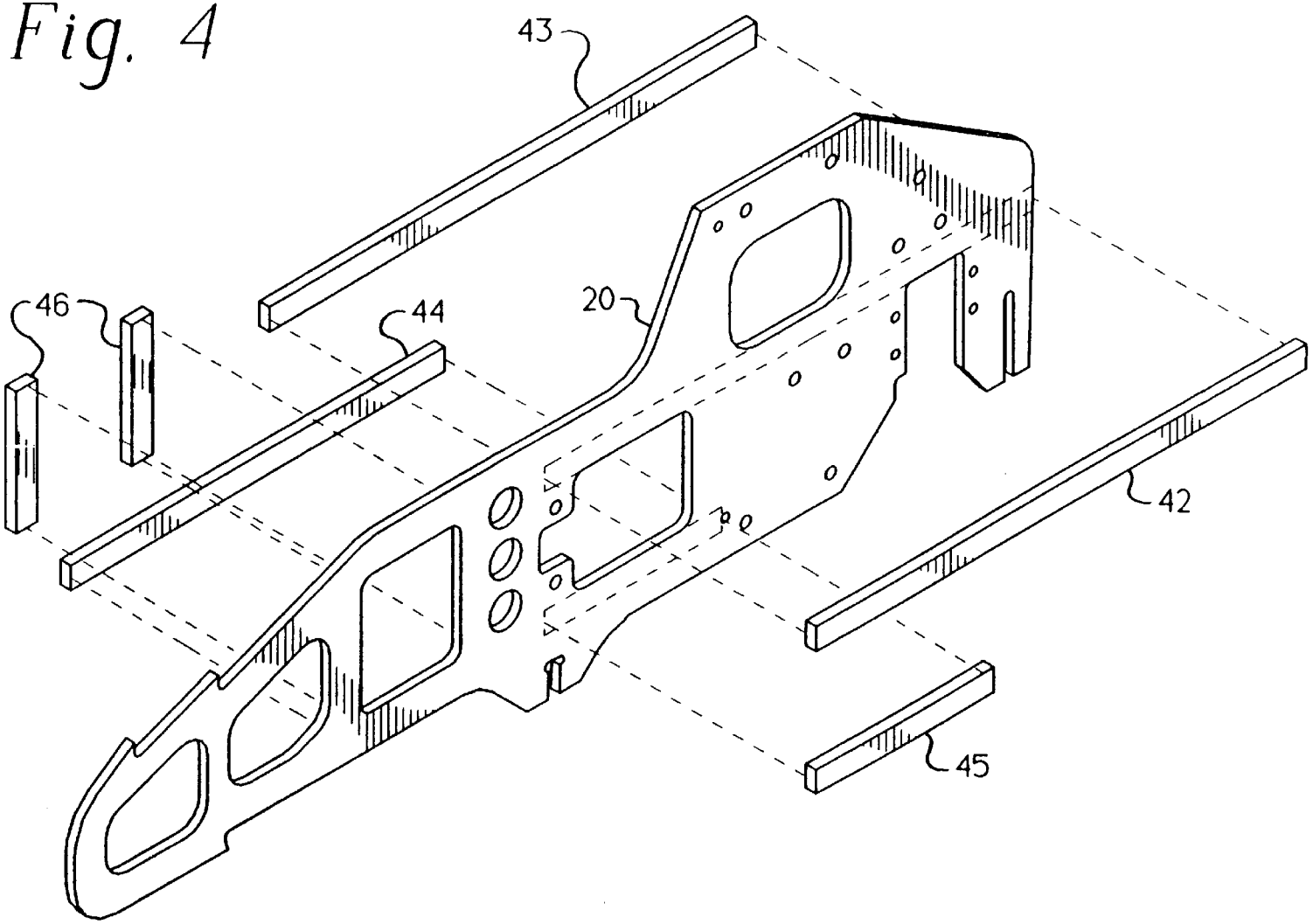
FIG. 4 is a perspective view of the elongated, flat keel showing the placement of stiffeners on the keel, with all other parts of the helicopter removed for clarity.

Fuselage 19 further includes keel stiffeners 42, 43, and 44 and servo risers 45 and 46 attached to keel 20 as shown in FIG. 4. Stiffeners 42, 43, and 44 primarily stiffen keel 20 longitudinally, while servo risers 45 and 46 provide raised mounting surfaces receptive to self-tapping screws used for mounting servos 15. In a preferred embodiment of the present invention, keel stiffeners 42, 43, and 44 and servo risers 45, 46 are strips of spruce wood and are attached to keel 20 with glue.

Figure 5:
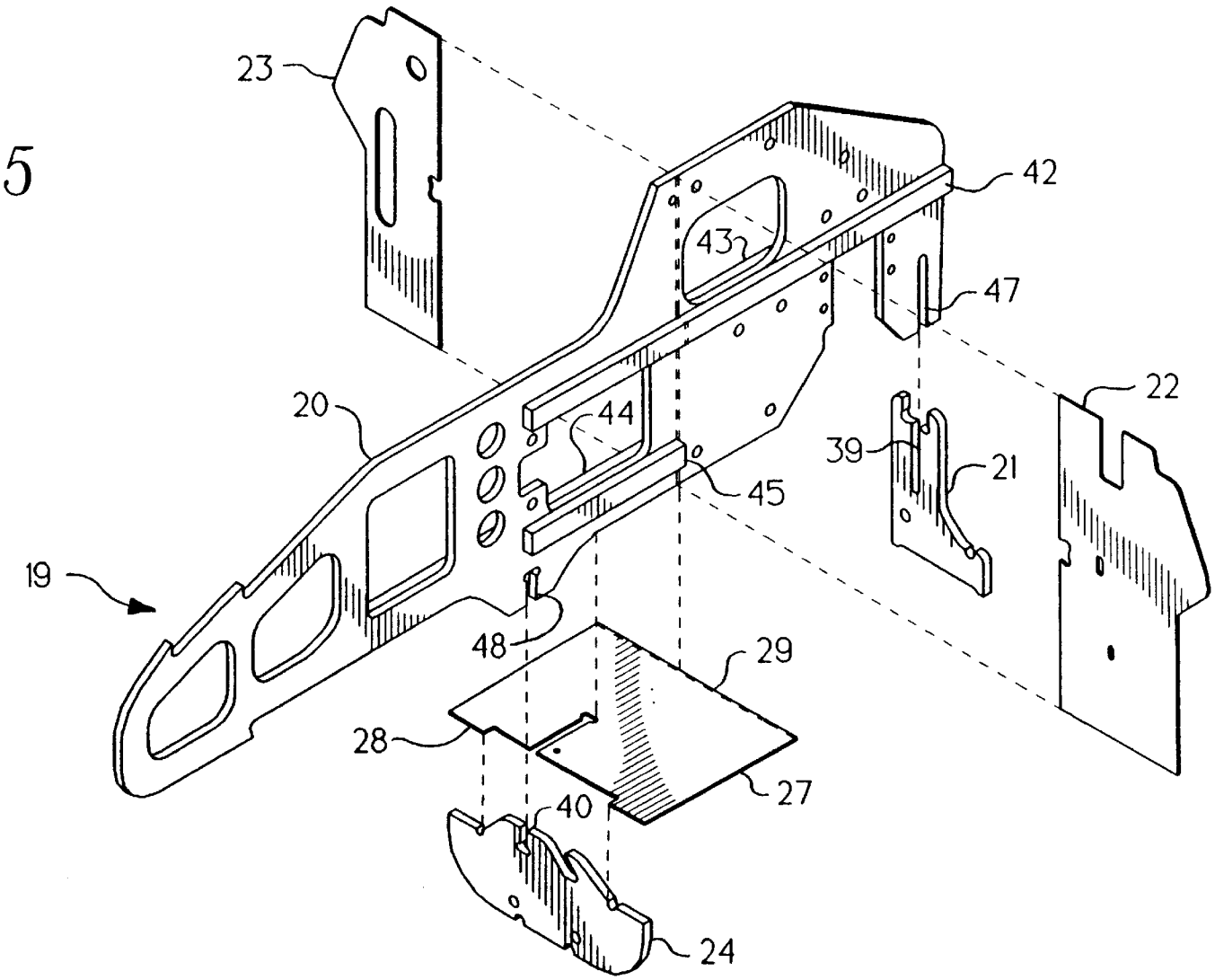
FIG. 5 is a view similar to FIG. 4 showing the orientation of the various fuselage structural elements shown in FIGS. 3*b* to 3*f* in relation to the keel and to each other.

The components of fuselage 19 are assembled as shown in FIG. 5. Landing gear bracket 21 is fixed (as by gluing) to keel 20 by inserting landing gear bracket 21 into alignment slot 47 formed in keel 20 until keel 20 extends completely into bracket slot 39 formed in landing gear bracket 21. In a similar fashion, landing gear bulkhead 24 is secured to keel 20 by connecting interlocking bracket slot 40 and alignment slot 48 formed in keel 20. Floor 27 is attached to landing gear bulkhead 24, keel 20, and fire wall halves 22 and 23 which are also affixed to keel 20. Floor 27 is situated perpendicular to keel 20. After assembly, the structural elements shown in FIG. 5 are collectively referred to as fuselage 19. Alternate embodiments of the present invention are envisioned wherein fuselage 19 is made of plastic such as nylon or polycarbonate with bulkhead 24, fire walls 22, 23 and/or floor 27 elements molded integrally to keel 20, or attached with adhesives or mechanical fasteners. Other alternate embodiments are envisioned wherein a second keel piece similar to keel 20 is attached in spaced-apart relation to keel 20 and separated by spacers such as keel stiffener 42 and servo riser 45 to form a box structure. It will be understood that such box structure will function like a single keel 20.

Landing gear bracket 21 and landing gear bulkhead 24 support landing gear assembly 53 as shown in FIG. 6. Landing gear assembly 53 includes front struts 50, rear struts 51, and spaced-apart skids 52. Landing gear assembly 53 is rigidly mounted to fuselage 19 with cable ties 54. Central landing gear vertex 55 formed between two front struts 50 abuts the rearward face of landing gear bulkhead 24 and the lower edge of bulkhead reinforcement 25 attached to landing gear bulkhead 24 as shown in FIG. 3d. Central section 56 joining rear struts 51 is held firmly against the bottom edge of bracket 21 by cable ties 54.

It is understood that landing gear bulkhead 24, floor 27, keel 20, and fire wall halves 22, 23 form a series of mutually supporting structural elements which greatly increase the strength and stiffness of fuselage 19. These structural elements also separate and protect forward section 84 of fuselage 19 inside canopy 4 from oily engine exhaust and airborne debris as shown in FIGS. 1 and 2. This is advantageous because radio receiver 12, battery 14, and servos 15 are housed in forward section 84.

The location of radio system 12 and engine drive train components on fuselage 19 is shown in FIGS. 7 and 8, with electric wiring between radio system 12 components removed for clarity. Servos 15 include tail rotor servo 69, throttle servo 70, fore-aft cyclic servo 71, and roll cyclic servo 72. All of servos 69–72 are positioned in forward section 84 of fuselage 19. Pushrods 73–76 and bellcrank 145 connecting the servos 69–72 with swashplate 78, engine 3, and tail rotor 2 are shown more clearly in FIG. 9. Tail rotor servo 69 is located within servo bay 33 in keel 20 with tail rotor pushrod 73 running nearly parallel to tail boom 67 back to the pitch control linkages of tail rotor 2 as shown in FIGS. 7–9. Throttle servo 70 is also located in servo bay 33 with throttle pushrod 74 operably connected to the speed controls of engine 3. Fore-aft cyclic servo 71 and roll cyclic servo 72, which are operably connected to swashplate 78 and control the tilt of main rotor 1, are located in servo bay 34 in close proximity to swashplate 78 so that fore/aft pushrod 75 and right/left pushrod 76 are short and direct.

The power train of helicopter 10 shown in FIGS. 7 and 8 includes clutch-assembly 89 (shown in more detail in FIGS. 12–14*b*) having clutch pinion 92 and starter cone 90 connected to engine 3 through clutch shaft 234 and driving main gear 91 secured to the lower end of main shaft 93. Main shaft 93 extends through ball bearings in lower ball-bearing block 94 and upper ball bearing block 95 and is operably connected at its upper end to main rotor 1. Ball-bearing blocks 94, 95 are secured to keel 20 in rear portion 86 of fuselage 19.

Figure 17:
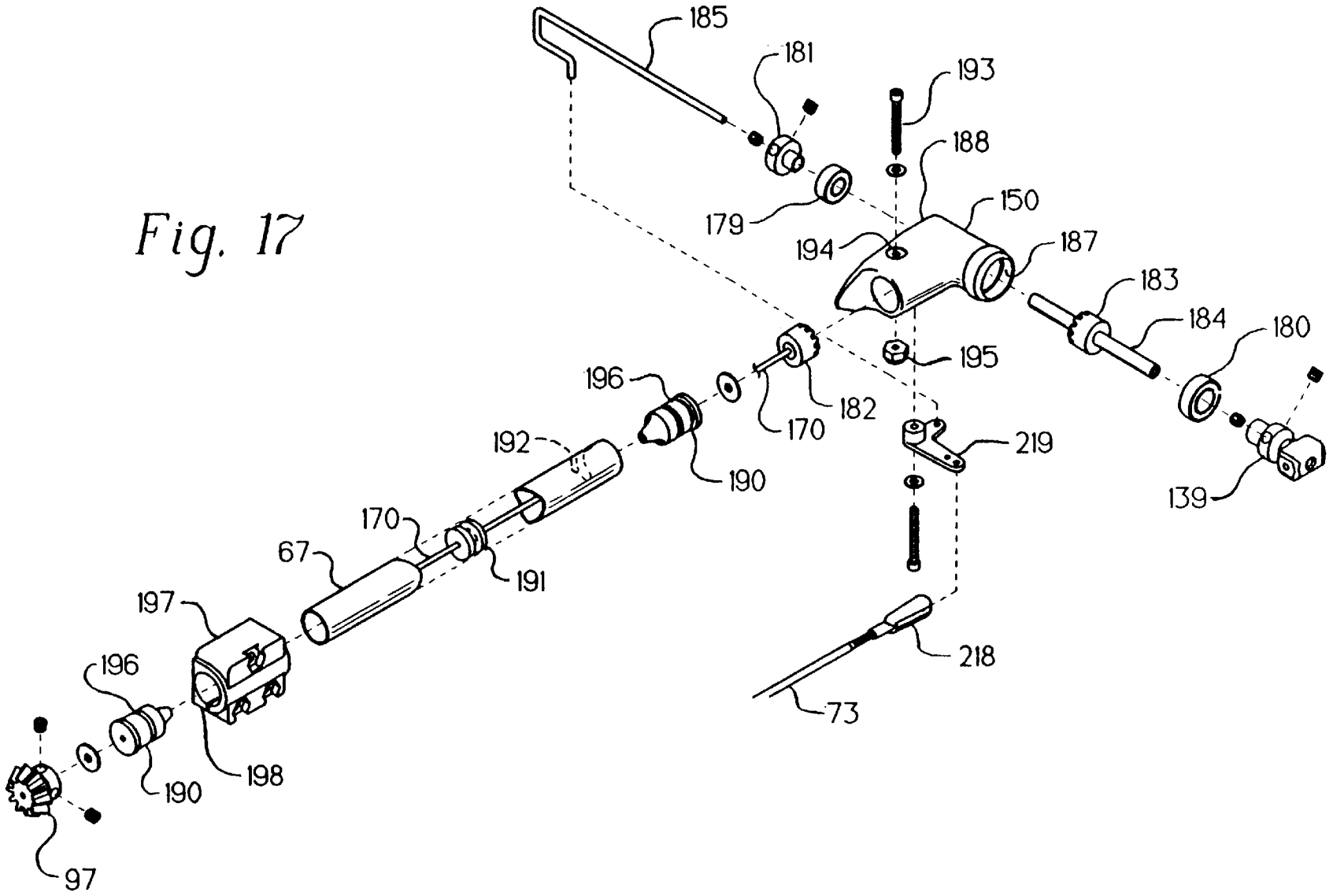
FIG. 17 is an exploded perspective view of the tail boom and tail rotor gearbox mechanism of the model helicopter illustrated in FIG. 1, with the tail boom sectioned into pieces to show interior detail.

Main shaft 93 transfers rotation for the power train to main rotor 1 and tail rotor 2. Main rotor 1 is directly connected to main shaft 93 and rotates with main shaft 93. Rotation is transferred from main shaft 93 to tail rotor 2 by crown gear 96, tail rotor pinion gear 97, and a tail rotor drive shaft 170 that is positioned to lie in an aperture formed in tail tube 67 as shown in FIG. 17. Crown gear 96 is securely fastened to main shaft 93 and engages tail rotor pinion gear 97 which is affixed to the tail rotor drive shaft 170 inside tail tube 67. In operation, excess oil from engine 3 drips into clutch assembly 89 thereby lubricating interior clutch elements including the interior of clutch pinion 92. In preferred embodiments of the present invention, the engine is a COX TD .049/.051.

Engine 3 is typically started with electric starter motor 121. Figs. lO*a*–11 illustrate starting procedures for engine 3 and show an operator holding helicopter 10 and applying electric starter motor 121 (with the motor shaft rotating in starter rotation direction 123) firmly to starter cone 90 with force applied in the direction of contact arrow 122. Engine 3 includes a crankshaft or output shaft 235 extending along a crankshaft or output shaft axis 312 as shown, for example, in FIG. 19. Starter cone 90 is operably connected to crankshaft 235 of engine 3 so that rapid rotation of starter cone 90 causes engine 3 to start. Starter cone 90 has cylindrical portion 118 for centering soft rubber insert 124 of starter motor 121 onto starter cone 90 and concave surface 117 against which rubber insert 124 can apply the torque necessary to start engine 3.

Having described the construction of a radio-controlled model helicopter in accordance with the current invention, reference will now be made to the remaining drawings which illustrate the particulars of the current invention. To understand the current invention as a whole, it is easiest to start with an understanding of the operation and application of its basic functional elements, and the contribution each element makes toward improving durability and performance and reducing complexity and cost. Once these basic elements are individually understood, their value in combination will become evident. Additional, more detailed information can be found in the patent record cited for each of the component parts.

Engine Power Allocation

The single most important attribute of radio-controlled model helicopter 10 shown in FIG. 1 is its ability to fly. This ability stems from the capabilities of main rotor system 1 and from the proper allocation of engine power to the various parts of the helicopter such as main rotor 1, tail rotor 2, tail rotor gyro 202, and engine cooling system 8 and mechanical drive train components such as gears 91, 92, 96, 97, 182, and 183. Proper engine power allocation is especially important for small radio-controlled model helicopters because of the aerodynamic inefficiencies of small scale rotors and the high weight of the radio control system when compared to the rest of the helicopter. It is sometimes possible to make a poorly designed model helicopter fly by adding a more powerful engine. But superior results can be achieved through enlightened design.

Experiments on conventional radio-controlled model helicopters have shown that only about 50% of the engine power produced by the engine is absorbed by the main rotor system. Of the remaining engine power, 15% to 20% is typically consumed by the tail rotor, 15% to 20% by the engine cooling system, and the remainder is lost through inefficiencies in drive mechanics such as bevel gears. Any decrease in the engine power consumed by the tail rotor 2, engine cooling system, and mechanics will increase the power available to the main rotor 1 and thereby increase the performance potential of the helicopter 10.

The present invention illustrates the proper allocation of engine power for improved flight performance, especially on small-and mid-size radio-controlled model helicopters. Helicopter 10 shown in FIG. 1, for instance, requires only about 10% of available engine power for tail rotor 2 and gyro stabilizer 202 combined, with no power lost for engine cooling. The result is that 90% of engine power is allocated to the main rotor 1 and drive train components 91, 92, 96, 97, 182, and 183 using an engine power allocation system in accordance with the present invention. This is about 30% to 40% more power than is available for main rotor 1 as compared to conventional radio-controlled model helicopters.

Testing a Model Helicopter To Determine How Much Engine Power Is Allocated To The Main Rotor System and Tail Rotor System A model helicopter 10 may be tested to determine how engine power is allocated to main rotor 1 and tail rotor 2. The model helicopter 10 to be tested is placed on a test stand (not shown) that includes a test stand motor (not shown). The test stand motor (not shown) is connected to the main shaft 93 of model helicopter 10 to provide engine power to the main rotor 1 and tail rotor 2.

First, the total engine power required to operate main rotor 1 at a selected main rotor 1 speed and tail rotor 2 at a selected tail rotor 2 speed is determined. A dynamometer (not shown) measures the torque required to drive the main rotor 1, tail rotor 2, and drive train components and the rate of rotation of main shaft 93 to rotate main rotor 1 at the selected main rotor 1 speed and tail rotor 2 at the selected tail rotor 2 speed. The total engine power required is then calculated by multiplying the measured torque required to drive the main rotor 1, tail rotor 2, and drive train components and rate of rotation of main shaft 93 about main rotor axis 5.

Second, tail rotor 2 is removed and the engine power required to rotate main rotor 1 at the selected main rotor 1 speed is determined in the same manner by using the dynamometer (not shown) to measure torque required to drive the main rotor 1 and drive train components and rate of rotation of main shaft 93. The power required by tail rotor 2 is the difference between total power required and the power required to drive main rotor 1 and drive train components without tail rotor 2. Third, main rotor 1 is removed and the engine power required to rotate tail rotor 2 at the selected tail rotor 2 speed is determined in the same manner by using the dynometer (not shown) to measure torque required to drive the tail rotor 2 and drive train components and rate of rotation of main shaft 93. The power required by main rotor 1 is the difference between total power required and the power required to drive tail rotor 2 and drive train components 91, 92, 96, 97, 182, and 183.

Mechanical and Aerodynamic Effects of Scale

The mechanical and aerodynamic effects of scale have a large influence on how durable a model helicopter will be and how well it will fly. In general, strength and stiffness are both described as a force divided by an area. For instance, the maximum tensile strength of certain steels is 100,000 pounds per square inch of cross-sectional area (100,000 psi). The characteristic force that a given structural member can withstand before bending or breaking is a property of the material and the cross-sectional area of the structural member. A one inch diameter rod of the aforementioned steel, for example, can support a 100,000 pound tensile force. To increase durability (which can be though of as the resistance to permanent deformation or breaking) of the structural member, helicopter designers often concentrate on increasing the strength of the materials used in the structural member. This is understandable, because the size of the helicopter is usually determined by operational considerations, such as high desired payload capacity, and is taken as a given by the designer.

While there are many ways of increasing durability (the resistance to crash damage), such as through clever structural design or the use of space-age composite materials, preferred embodiments of the present invention exploit the structural advantages of small scale.

If designed with the features disclosed herein, small models can be made more durable than large models, in part because small things are stronger and stiffer for their weight than large things. This can be explained as follows.

The strength of a certain structural member, such as in the framework of a helicopter, varies as the square of the size of the structural member. For instance, if a rod one inch (2.5 cm) diameter can support 100 pounds (45 kg), then a two inch (5.1 cm) diameter rod of the same material can support [100 pounds×2×2]=400 pounds (180 kg). Forces that affect structural members, such as the force of gravity and the force caused by rapid deceleration during a crash, vary as the cube of size. For instance, if a one inch (2.5 cm) diameter rod weighs one pound (4.4 N), then a rod twice as big would weigh [one pound×2×2×2] =8 pounds (35.6 N).

This means that the strength-to-weight ratio of structural members is inversely proportional to size. The strength-to-weight ratio of the one inch (2.5 cm) bar previously considered equals 100. The strength-to-weight ratio of the two inch (5.1 cm) bar is only 50. Small things are naturally stronger for their weight. For the same reasons, small things are also stiffer for their weight.

A byproduct of small size is that many operational forces are substantially lower. For instance, the main rotor blades on a large radio-controlled model helicopter (e.g., a helicopter with an engine of 0.60 cubic inch displacement and blade diameter of 50 inches) may pull outward in flight with over 500 pounds of force. In contrast, the blades on a small helicopter 10 with a 24 inch blade diameter may pull with only 20 pounds of force. That is a difference of 2,500%. Rotor blade tip speeds are also lower (250 mph vs. 110 mph for example) so impact forces are correspondingly lower. This means, for instance, that inexpensive pin-joints and bushings may be used in place of ball bearings to support mechanical elements of the helicopter that must pivot or rotate. So, small scale structures are stronger and stiffer for their weight and the forces they encounter are orders of magnitude smaller. Small size makes for very durable structures.

Given the many advantages of small-scale structures, it would follow that small helicopters would be very popular by virtue of their durability. Historically, however, small remote-controlled helicopters have been seen as fragile and underpowered. This is because small size is advantageous mechanically and structurally, but not aerodynamically. As size decreases, so does aerodynamic efficiency (lift produced per unit of power required).

The amount of air a rotor system can move to produce useful lift depends upon the swept area of the rotor system (hereinafter the "disk area"), surface area of the blades, and tip-speed of the blades. All of these factors decrease dramatically with decreasing size. In addition, the aerodynamic drag developed by a rotating rotor blade airfoil depends greatly upon a scale factor called the "Reynolds number" which is a function primarily of the airfoil chord and speed of rotation (as would be understood by one skilled in the art). At low Reynolds numbers, airfoil drag (referred to as CD)

increases dramatically, so small scale rotors are usually very inefficient. Designers of remote-controlled model helicopters compensate for the deficiencies of their rotor systems by building fragile; light weight structures just to get their helicopters into the air.

Model helicopter designers, who are more often hobbyists than professional engineers, frequently fail to consider the differences between large-scale and small-scale structures and aerodynamics and base their model designs on full-size helicopters. When scaled down to model proportions, their small rotor systems are typically so inefficient at producing lift that many small helicopters can hardly get off the ground. To compensate for low lift rotors, the structures of small model helicopters are typically light weight and fragile and incapable of absorbing much abuse before breaking. As a consequence, modern model helicopters are still expensive, complex, and fragile and the general public consensus has been that small model helicopters are impractical and undesirable.

Although many model helicopter designs exist, no known design or method of manufacture has produced a model helicopter that is capable of both flying well and surviving repeated energetic crashes, such as impacts with a brick wall or tree trunk. What is needed are efficient, durable and inexpensive components for use on model helicopters. To be practical, the main rotor of the helicopter must generate enough lift to allow the helicopter to fly well. To be popular and appropriate for the general public, the helicopter must absorb the punishment of the unsophisticated novice. To be a commercial success, the helicopter must be inexpensive and easy to manufacture.

Many successful designs currently exist for radio-controlled model helicopters, any one of which can be scaled down to a smaller size. The problem, however, is that helicopters scaled down from larger sizes will not fly and are unnecessarily complex and expensive. To make them fly, designers reduce the weight and strength of the structure and abandon any advantages of scale they may have had. The present invention solves the mechanical, structural and aerodynamic problems of a small and mid-size helicopters, and makes them practical in a variety of forms. In the context of the current invention, small size is not merely an advantage, it is a feature.

While elements of the current invention (such as the fuselage structure, rotor aerodynamics, tail rotor configuration, and mechanical gyro stabilizer) may be applied to large model helicopters powered by engines of 0.60 cubic-inch displacement or more (with about 1.8 horsepower, and rotor spans of about 56 inches), the present invention is best suited for application to midsize model helicopters having engines of about 0.30 cubic-inch displacement or less (with about 1.2 horsepower, and rotor spans of about 50 inches or less). Because of the scale effects cited above, the present invention is especially well suited to small model helicopters having engine displacements in the 0.05 to 0.15 cubic-inch range (with about 0.1 to 0.4 horsepower, with rotor spans of about 24 to 36 inches).

Note that the present invention may be powered by an equivalent electric motor system. Helicopters driven by electric motors are typically heavier and have lower available power than are helicopters powered by gas engines. As a consequence, electric helicopters must be as efficient as possible, so the present invention is especially effective on electric helicopters.

The physical size of the present invention is an important design parameter not fully considered in other radio-controlled model helicopter designs. If the design goal is to produce a powerful, sophisticated helicopter capable of lifting a heavy payload or performing energetic acrobatic maneuvers, then large size and high power is an advantage. But, if the goal is to produce a simple, inexpensive, durable remote-controlled model helicopter for widespread use by the general public, then small size is a distinct advantage that has been neglected. Embodiments of the present invention advantageously exploit the benefits of small scale structures for increased durability and reduced complexity. Efficient, small scale rotors are provided that make flight of very small helicopters possible.

Engine Configuration

Traditionally, model helicopters have employed a powerful fan to cool the engine. Even with a fan, the engine, which is typically a modified airplane engine, usually requires an enlarged cylinder-head heat-sink with over-sized cooling fins in order to cool properly. As shown in FIG. 1, and in more detail in FIG. 9, model helicopter 10 utilizes oversized engine cooling fins of heat sink 8 on engine 3 to convect engine heat away passively to the surrounding atmosphere. Because no fan is required, no engine power is lost to a fan. This also simplifies the installation of engine 3 and greatly reduces the weight, complexity, and cost of helicopter 10. While the concept of passive engine cooling on model engines itself is not new, passive engine cooling is uniquely combined with other features of the present invention for greatly improved helicopter performance.

The engine power consumed by an engine cooling fan on a radio-controlled model helicopter can dramatically affect how well the helicopter flies. Assume, for instance in FIG. 1, that main rotor 1 of helicopter 10 consumes 50% of the power produced by engine 3, and that engine 3 is cooled by a cooling fan consuming 15% of the power. If 15% of the power of engine 3 can be diverted from the cooling fan to main rotor 1, then the power available to main rotor 1 would increase from 50% to about 65% of engine power—an increase of 30%. This could increase main rotor lift by as much as 30%.

Model helicopters, however, have cooling fans for a reason. Large model airplane engines used on traditional model helicopters typically do not have adequate surface area for proper cooling without a forced-air cooling fan. Helicopter engines are also usually surrounded by a fuselage framework that limits convective airflow around the engine.

Small engines, on the other hand, have more surface area per unit volume than do large engines, and cool faster than do large engines. Small model car engines in the range of 0.05 to 0.15 cubic inch displacement, while not intended for model helicopters, are ideally suited for helicopters because they generally have oversize cooling fins and have output drive shafts designed to accept the side loads generated by drive gears. Small helicopters powered by these engines, however, currently do not exist because of the problems designers have traditionally had making small helicopters fly. The present invention makes small helicopters powered by passively cooled engines both practical and desirable.

In a preferred embodiment of the current invention shown in FIG. 2, and more clearly in FIG. 7, engine 3 is mounted aft of fire wall left half 22 in rear section 86 of fuselage 19, and oriented with output end 310 of crankshaft 235 pointing substantially downward. This location behind fire walls 22 and 23 is advantageous as the heat and oily exhaust of engine 3 are separated from the radio-control equipment in forward section 84 of fuselage 19. Downward pointing orientation of engine 3 is also beneficial in many regards. It allows engine 3 to drive main rotor 1 through main gear 91 directly without intermediate bevel gears or belting (as is common on some mid-size radio-controlled model helicopters) and allows easy access to engine 3 for starting and maintenance. Main gear 91, tail rotor crown gear 96, and pinion gear 97 are also better proportioned to the rotors they are driving (big gear/big rotor, little gear/little rotor). Because main gear 91 is large in diameter relative to clutch pinion 92 on engine 3, driving forces on the gear teeth are relatively low. On conventional helicopters using relatively small bevel gears to drive the main rotor, the driving forces are proportionately higher leading to premature wear and gear and bearing failures.

Another advantage of the present engine configuration can be seen in FIG. 7. Main rotor shaft 93, which is operably connected to the top of keel 20 by upper bearing block 95 and to the bottom of keel 20 by lower bearing block 94, is not only well supported, but also contributes structurally to keel 20. Forces emanating from main rotor 1 that could damage keel 20 (as could be generated during a crash of helicopter 10 into the ground at high speed) are transmitted to the upper and lower portions of keel 20 simultaneously by shaft 93. If shaft 93 extends down from main rotor 1 only as far as crown gear 96, and is mounted only at the top of keel 20 above crown gear 96, bending forces during a crash of helicopter 10 could break off the top of keel 20.

It will be understood that many different types and brands of engines (or electric motors) may be utilized with the present invention. The engine shown in the drawings is a Cox TD 0.051/H made by Cox Products in the United States which generates about 0.9 horsepower at the, nominal maximum speed of 19,500 RPM. A model car engine, such as an OS 0.10 FP-B, made by OS Engines of Japan, would be advantageous for use in a small helicopter having an engine configuration in accordance with the present invention.

It will be understood from the foregoing, that the configuration and orientation of engine 3 in the present invention improves power allocation and reduces the complexity and cost of the present invention. The features of engine configuration and engine orientation may be combined with other features of the present invention for additional benefits.

Although not required for small engines, a small, low power fan may be added to blow away hot air from around larger engines with oversized heat sinks. Such a fan should be sized to consume no more than 5% of engine power. This would be useful on helicopters where the fuselage framework limits convective airflow around the engine and engine heat sink.

Clutch Assembly

Refer now to FIGS. 12–14*b*. Clutch assembly 229 is a mechanical interface between engine 3 (or an electric motor) and the main and tail rotor power transmission systems of helicopter 10. Clutches on radio-controlled model helicopters are usually designed to disengage at low engine speeds so that engine 3 may idle without turning main rotor 1 or tail rotor 2, or stop completely while the rotors are still turning. Novel clutch assembly 229 of the present invention is exceptionally low weight, compact, easy to manufacture and ideally suited for use on small model helicopters.

As shown in FIGS. 12–14*b*, clutch assembly 229 has clutch shaft 230 supporting clutch bell 89, clutch shoes 231, and starter cone 90 on the output end 310 of crankshaft 235 of engine 3. Clutch shoes 231 define a clutch shaft-receiving channel 320 and clutch bell 89 is formed to include a clutch shaft-receiving channel 322. Clutch shaft 230 has threaded end 233 which passes through clutch shaft-receiving channel 320 of clutch shoes 231 and screws into a channel 316 formed in the hollow output end 310 of crankshaft 235 of engine 3, thereby fixedly securing clutch shoes 231 onto the output end 310 of crankshaft 235. Clutch shaft 230 also extends through clutch shaft-receiving channel 322 formed in clutch bell 89. Clutch shaft 230 has wrench flats 237 and generally cylindrical rod-end 234 on which clutch bell 89 is free to rotate. Starter cone 90 is secured to clutch shaft 230 by set-screw 236, and is provided to transmit rotary motion of an electric starter-motor to engine 3 to facilitate starting (as shown in Fig. 10*a*). Shoe portions 228 are connected to body portion 226 of clutch shoes 231 by flexible shoe bands 225 that allow shoes portions 228 to expand slightly away from body portion 226.

In operation at high speed, centrifugal forces throw shoe portions 228 of clutch shoes 231 outward away from shaft 230 against the interior of clutch bell 89 causing clutch bell 89 to rotate with crankshaft 235 of engine 3. At low speed (below about 4,000 RPM in the preferred embodiment) shoe portions 228 do not contact clutch bell 89, so clutch shaft 230 is free to rotate within pinion gear 92 without turning clutch bell 89.

Clutch bell 89 is made from an abrasion resistant plastics material, such as nylon, with a high melting point (preferably above 300 degrees F), and is molded around the top of clutch bell pinion gear 92 in the embodiment shown. Pinion gear 92, which is preferably made of steel or bronze, has undercut geometry 227 on one end to permanently retain it within the plastic material of clutch bell 89, so no additional mechanical fasteners are required between clutch bell 89 and pinion gear 92. Plastic clutch bell 89 is roughly 60% lighter than a conventional aluminum clutch bell as would be found on other, larger helicopters, and is substantially more compact in the axial direction because no provision for mechanical fasteners is necessary.

The mounting configuration of clutch assembly 229 on engine 3 is unique among model helicopters. Because engines for model helicopters were developed from airplane engines, they generally have a threaded stud extending from the end of the crankshaft for attaching a propeller and propeller nut. Clutch assemblies on most model helicopters must accommodate this mounting scheme and are typically bulky and require multiple ball bearings to support a clutch bell. In contrast, crankshaft 235 on engine 3 has channel 316 formed in output end 310 which is threaded on the interior to accept a standard threaded bolt. Clutch shaft 230 screws into the hollow output end 310 of crankshaft 235 rather than over a threaded stud, so rod-end 234 may be much smaller in diameter than the clutch shafts on other model helicopters. Advantageously, thin shafts like rod-end 234 are well suited for use with plain bearings (bushings), and pinion gear 92 is drilled for use as a plain bearing.

Because pinion gear 92 is drilled for use as a plain bearing and requires no ball bearings to support it for rotation on rod-end 234 of clutch shaft 230, it can be very small in diameter. This is important because main spur gear 91 (see FIG. 1) must be eleven times larger than pinion gear 92 for a pinion-gear/spur-gear ratio of 11 to 1 as is used on a preferred embodiment of the present invention. A pinion of double the present diameter, for instance, would require spur gear 91 to be so large that it would not practically fit on helicopter 10.

The current clutch design exploits the orientation of engine 3 to support clutch assembly 229. When clutch shoes 231 disengage clutch bell 89 at idle, the weight of clutch bell 89 rests on pinion gear 92 and metal washer 240. This minimizes wear on the outside surface of rod-end 234 of clutch shaft 230 and the inside surface of pinion gear 92. If engine 3 were oriented with the crankshaft axis horizontal, the weight of clutch bell 89 would rest on the inside surface of pinion gear 92, or on a ball bearing assembly as is commonly required on other model helicopters. Another advantage of the engine/clutch combination in accordance with the present invention is that oil dripping into clutch bell 89 from engine 3 lubricates clutch shoes 231, and is funneled to the center of clutch bell 89 to lubricate the interior of pinion gear 92. Drain holes 282 are provided in the bottom of clutch bell 89 to drain excess oil.

One-piece, centrifugally-actuated, aluminum clutch shoes 231 are ⅓ the weight of conventional steel shoes, and conduct heat 6 to 10 times faster. The combination of low power loading (about 0.08 horsepower spread across the contact area on the inside circumference of clutch bell 89), oil-drip lubrication, and heat-conducting clutch shoes 231 prevents clutch bell 89 from melting when clutch shoes 231 engage clutch bell 89 as engine speed increases from idle. At the higher power loadings of large model helicopters, a more complicated insulating liner may be needed to keep the clutch bell from melting, and expensive ball bearings may be required between the pinion gear and the clutch shaft.

It will be understood from the foregoing, that clutch assembly 229 of the present invention reduces the size, weight, complexity and cost of the present invention, and may be combined with other features of the invention, such as engine orientation, for additional benefits.

Main Rotor Configuration

Referring to FIG. 1, main rotor 1 on helicopter 10 is simple, durable, and aerodynamically efficient. The word "durable" as used herein generally describes elements that can withstand repeated crashes into the ground at flight speed without significant impairment of their operating qualities. A preferred embodiment of main rotor 1 is described in detail by Paul E. Arlton et al. in U.S. patent application Ser. No. 08/233,159, filed Apr. 25, 1994, and in a U.S. patent application entitled "Main Rotor System For Model Helicopters" filed on Oct. 11, 1996, which are incorporated herein by reference.

Figures 20A, 20B:
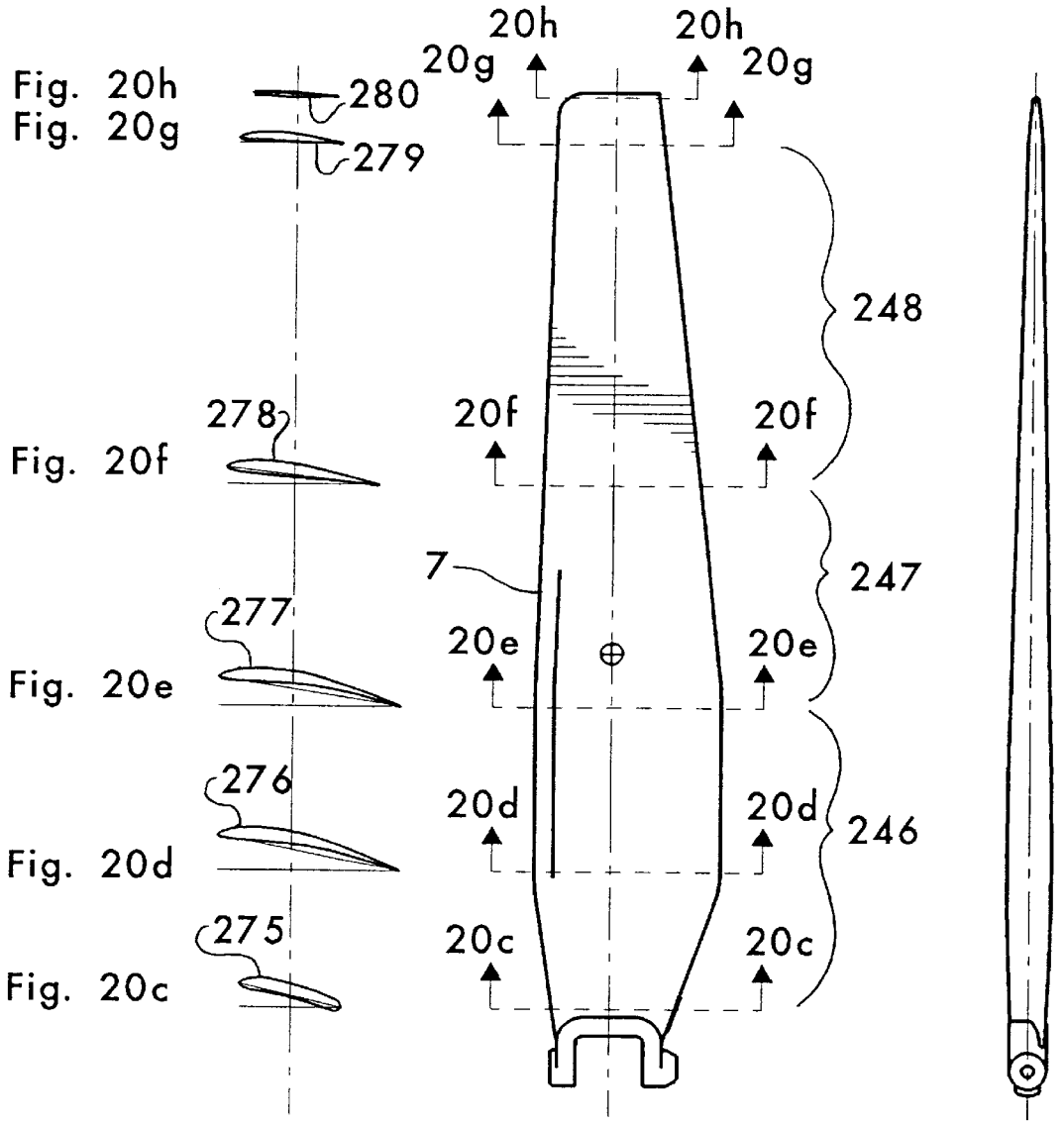

Main rotor 1 of helicopter 10 includes high lift, plastic rotor blades 7. FIGS. 20*a*–20*h* illustrate a preferred embodiment of rotor blade 7 having an inboard section 246, a transition section 247, and an outboard section 248. Inboard section 246 is generally wider in chord and has airfoils with higher camber than outboard section 248. The airfoils of inboard section 246 are generally thinner (as a percentage of local chord length) and set at a higher pitch angle than the airfoils of outboard section 248. Rotor blade 7 is especially well suited for use on a fixed-pitch rotor head since outboard 20 section 248 has a narrow average chord length relative to inboard section 246. Blade pitch adjustments on fixed-pitch rotor systems are less difficult if the chord of tip airfoil 279 is about half the length of the chord of root airfoil 276. As shown in FIGS. 20*d*–20*e*, airfoils 276 and 277 are 7.1% thick Sokolov airfoils with 6% camber pitched to 8.8 and 7.0 degrees respective to tip airfoil 280. Airfoils 278 and 279 are 9.2% thick SD7037-PT airfoils with 3% camber (developed by Michael Selig) pitched to 4.4 and 0.5 degrees respective to tip airfoil 280.

Figure 21:
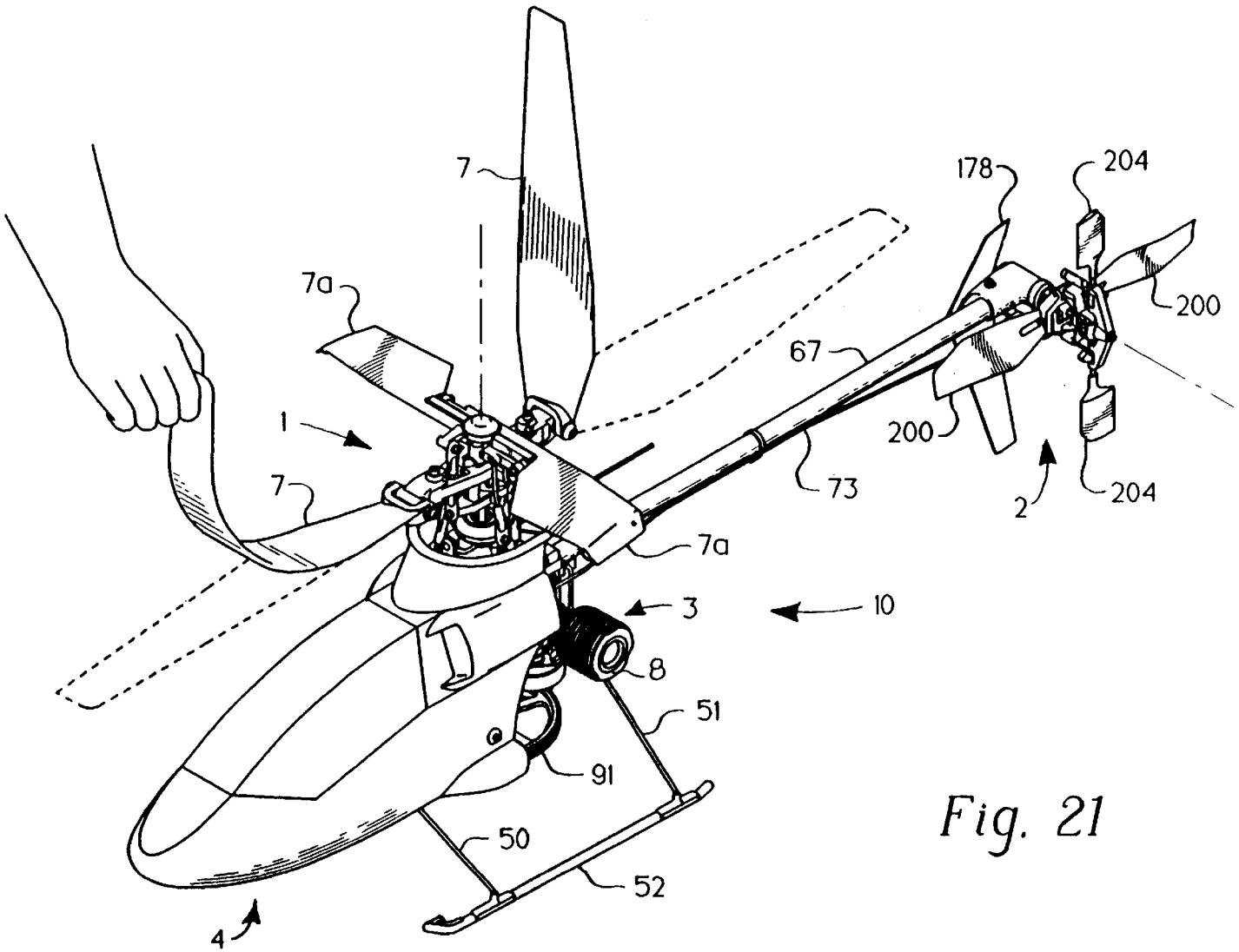
FIG. 21 is a perspective view of a model helicopter illustrating the flexible and foldable nature of a main rotor blades in accordance with a preferred embodiment of the present invention.

As illustrated by FIG. 21, blades 7 of main rotor 1 are very durable and can be flexed 90 degrees or more in a sharp radius by hand without damage, or folded upward past a flapping limit of about 6 degrees to a folded configuration 90 degrees or more above their normal orientation (extending radially from main rotor shaft 93) as shown in FIG. 21. Rotor blades 7 are preferably molded from a plastic material such as nylon, ABS or polycarbonate. In a crash of helicopter 10 into the ground or other obstacle, rotor blades 7 transform from a nominal primary configuration (extended radially from main rotor shaft 93), to a secondary configuration which may be flexed, folded or a combination of both. Rotor blade 7 can then be returned to the primary configuration without repair or material reduction of its flying qualities for continued operation.

Much of the lifting potential of main rotor 1 comes from the carefully selected cambered airfoils used in main rotor blades 7, and their relatively high speed of rotation (1,600 to 2,000 RPM in the preferred embodiment shown). High rotational speed also means that main rotor 1 will generate high gyroscopic stability, which improves flight performance of helicopter 10. While main rotor 1 is optimized for the best flight performance, acceptable performance can be obtained in alternative embodiments of the present invention if common cambered airfoils having 2% to 4% camber and 10% to 15% thickness are used on rotor blades 7 if other elements of the present invention are employed simultaneously.

Figure 22:
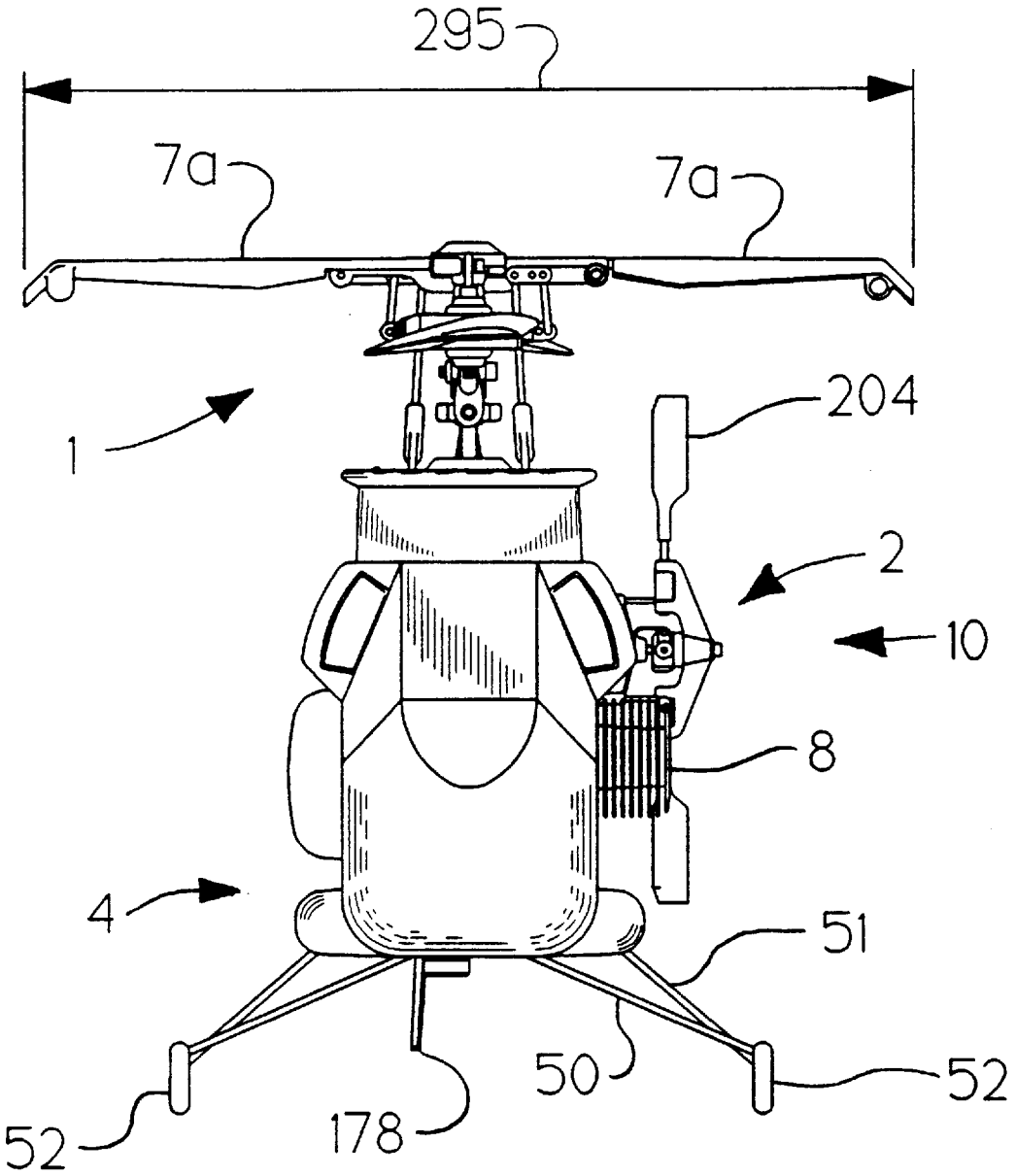
FIG. 22 is a front elevation view of a model helicopter in accordance with the current invention showing the size of the stabilizing rotor blades of the main rotor relative to the helicopter fuselage.

Stabilizing rotor blades 7*a* are preferably flexible and made of a molded plastics material such as nylon, and are operably supported to pitch about a spring steel pivot wire (not shown) that can withstand crashes that would permanently deform the standard soft wire of a standard Hiller flybar stabilizer found on other model helicopters. Similar to rotor blades 7, stabilizing rotor blades 7*a* have a primary radial configuration and a secondary flexed or folded configuration induced by crashes. With durable main rotor blades 7 and stabilizing rotor blades 7*a*, main rotor 1 can withstand repeated crashes into the ground at flight speed without significant impairment of its operating qualities. Stabilizing rotor 7 is shown to scale in FIG. 22 with a diameter 295 equal to 9.5 inches.

The main rotors of many mid-size and large helicopters operate at a maximum speed of about 1,600 to 2,000 RPM. These rotors are called "high speed main rotors" herein. The rotors of some small electric helicopters operate at a maximum speed of about 900 to 1100 RPM. These rotors are called "slow speed main rotors" herein. The embodiment of the present invention shown in FIG. 1 has a high speed main rotor 1 with a main rotor diameter 294 (shown in FIG. 23) of 24 inches operating at about 1,400 to 1,600 RPM in hover and at about 1,800 to 2,000 RPM maximum when powered by a Cox TD 0.051 engine.

High speed rotors have many advantages. High speed rotors are generally smaller in diameter than low speed rotors for a given amount of lifting potential. Because tail rotor 2 must be mounted at a clearance distance 291 from main rotor blades 7 (shown in FIG. 23), tail boom 67 of helicopter 10 equipped with a high speed main rotor 1 is naturally shorter than that of a helicopter with a large, low speed rotor. Short tail boom 67 is lighter than a long tail boom and requires less fuselage weight in front of main rotor 1 for proper fore/aft balance. A helicopter with a high speed main rotor, therefore, is naturally lighter than a helicopter with a low speed main rotor if all other design variables are held constant.

The fixed-pitch main rotor system of the present invention is uniquely simple and durable. The simplicity and durability are important factors for success for beginning model helicopter pilots who often cannot understand the complexities of collective-pitch rotor systems and who often crash their helicopters while learning to fly them. Alternative embodiments are contemplated wherein the fixed-pitch main rotor is replaced with a collective-pitch rotor system. This would increase the flight capabilities of the present invention without reducing durability, but at the cost of additional complexity.

It will be understood from the foregoing, that the main rotor system of the present invention substantially improves the flight performance and durability of the present invention and may be advantageously combined with other features of the invention, such as engine configuration and tail rotor configuration for additional benefits.

Tail Rotor Configuration

Figure 19:
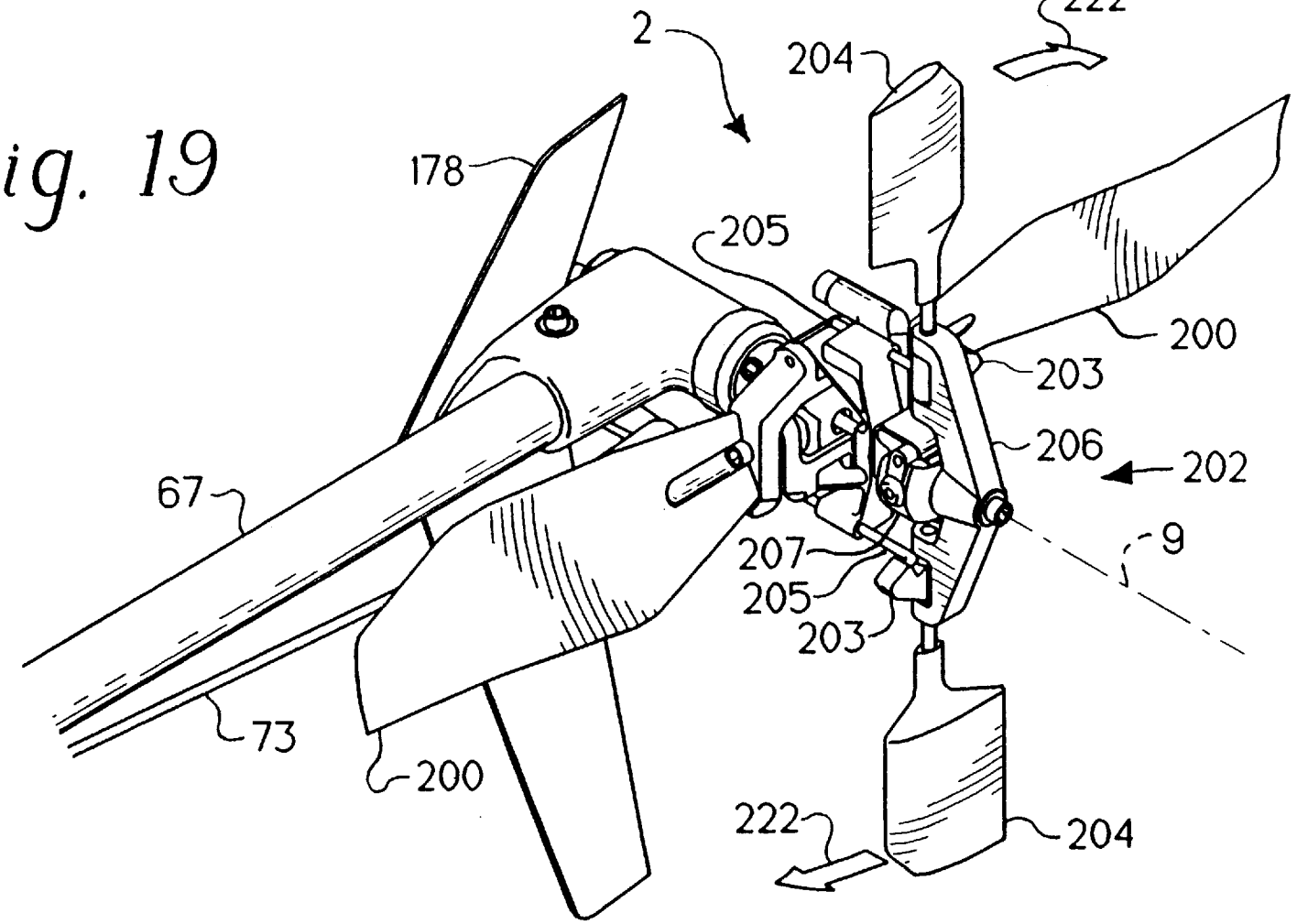
FIG. 19 is an enlarged perspective view of a preferred tail rotor assembly of the model helicopter illustrated in FIG. 1 fitted with a mechanical yaw control and stabilization system.

As shown in FIG. 19, tail rotor 2 of helicopter 10 illustratively includes tail rotor blades 200 and gyroscopic mechanism 202 rotating in rotation direction 222 about tail rotor axis 9. Tail rotor blades 200 preferably are injection molded from a plastics material such as nylon, and configured in accordance with a preferred tail rotor system described in detail by Paul E. Arlton et. al. in U.S. patent application Ser. No. 08/292,719, filed Aug. 18, 1994, which is hereby incorporated herein by this reference.

Because of the aerodynamics of small scale rotors, tail rotors of small model helicopters are not as efficient as similar rotors on larger model helicopters. Tail rotor 2 of the present invention is sized and operated at speeds that minimize power consumption and maximize thrust. In the illustrated embodiment, tail rotor 2 and gyro stabilizer 202 together consume roughly 10% of the power available from engine 3.

The engine power consumed by the tail rotor on a radio-controlled model helicopter can dramatically affect 35 how well the helicopter flies. Assume, for instance in FIG. 1, that main rotor 1 consumes 50% of the power produced by engine 3 in helicopter 10. If 10% of the power of engine 3 can be diverted from tail rotor 2 to main rotor 1, then the engine power available to main rotor 1 would increase from 50% to about 60% of engine power—an increase of 20%. This could increase main rotor lift by as much as 20%.

Traditional model helicopters have small diameter, low camber (about 3% or less of local chord length), high speed tail rotor blades that consume large amounts (15% to 20%) of available engine power. High speed tail rotors are desirable because they are less affected by wind gusts than are low speed tail rotors. The speed of a wind gust is a smaller percentage of the speed of the airflow exiting a high speed tail rotor than that of the airflow exiting a low speed tail rotor. High speed tail rotors require substantial engine power because the tail rotor blades are accelerating a relatively small amount of air to a very high velocity which can be very inefficient aerodynamically.

A preferred embodiment of the present invention employs large diameter, highly cambered (about 3% to 6% of local chord length), low speed tail rotor blades 200 to minimize the engine power consumption of tail rotor 2. It can be seen that by combining passive engine cooling with a large, slow speed tail rotor, engine power available to main rotor 1 can be substantially increased by as much as 30%+20%=50% in one example.

Figure 23:
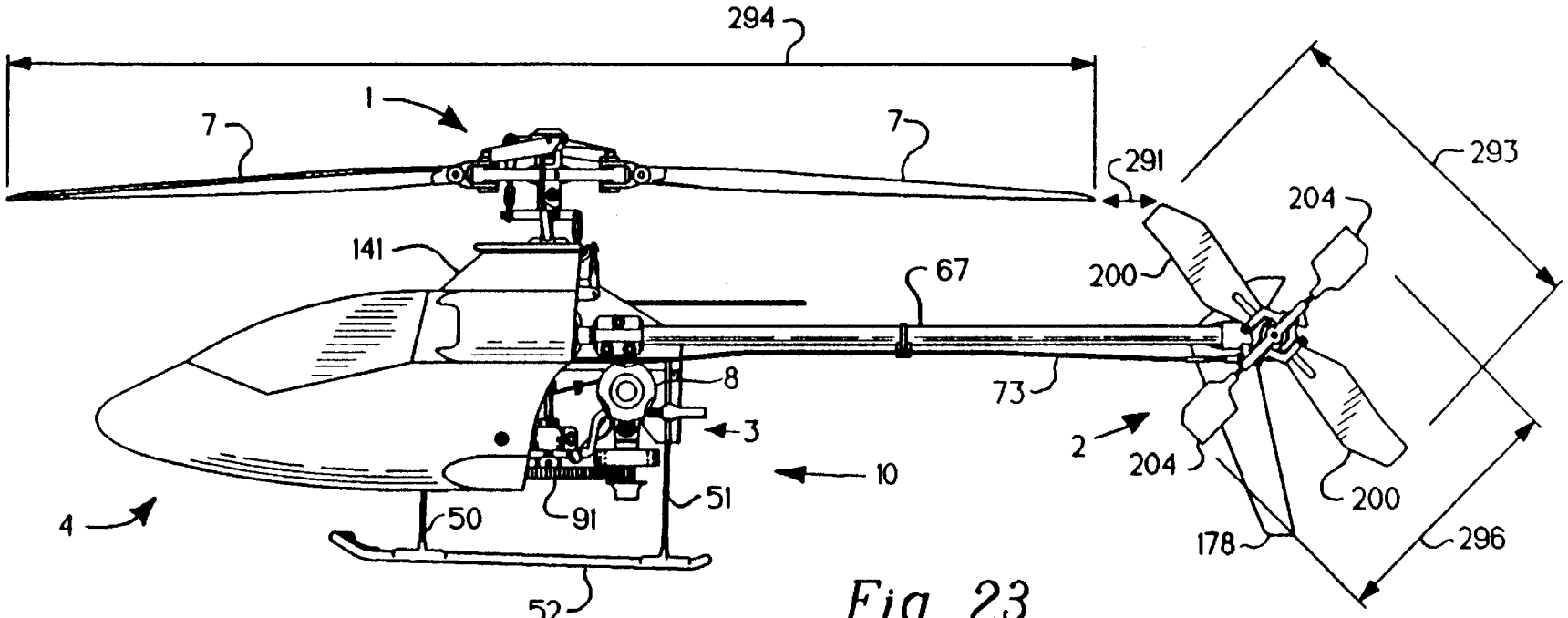
FIG. 23 is a side elevation view of a model helicopter in accordance with the current invention showing the size of the main rotor blades relative to the tail rotor blades, tail rotor yaw control and stabilization system, and fuselage of the helicopter.

The ratio of main rotor diameter to tail rotor diameter is referred to herein as the "disk diameter ratio". Common mid-size and large radio controlled model helicopters have disk diameter ratios of about 4.5:1 to 6.2:1 (main rotor:tail rotor). Tail rotor 2 on the present invention is preferably larger than that of other 35 helicopters for increased aerodynamic efficiency and lower power consumption. The disk diameter ratio of the embodiment shown in FIG. 1 is 3.2:1. Ratios in the range of about 3:1 to 4:1 are preferred to minimize the power consumption of tail rotor 2 and maximize the flight performance of main rotor 1. Tail rotors having a disk diameter ratio within this range are called "large tail rotors" herein. Tail rotor 2 of helicopter 10 in FIG. 23 is drawn to scale and has a diameter 293 of 7.5 inches. Mechanical gyro stabilizer 202 has a diameter 296 of 5.5 inches.

The ratios of engine speed to main-rotor speed, and tail-rotor speed to main-rotor speed. are referred to herein as "speed ratios". The speed ratios common to midsize and large helicopters are about 9:1 and 4.5:1 (engine:main rotor and tail rotor:main rotor). The ratios for a preferred embodiment of the present invention are 11.3:1 and 2.1 (engine:main rotor and tail:main rotor). Of these ratios, the ratio of tail rotor speed to main rotor speed is the most important and is referred to as the "tail rotor speed ratio". When used with a large tail rotor, tail rotor speed ratios in the range of about 2:1 to 3:1 (tail rotor:main rotor) are preferred to minimize tail rotor engine power consumption and maximize the flight performance of main rotor 1. Tail rotors operating within this speed ratio range are called "slow speed tail rotors" herein.

The speed ratio of the tail rotor 2 to main rotor 1 can be controlled, for example, by the number of gear teeth on tail rotor crown gear 96 and tail rotor pinion gear 97. The speed ratio of tail rotor 2 to main rotor 1 can be determined by counting the number of revolutions that tail rotor 2 makes for every revolution of main rotor 1.

It will be understood from the foregoing, that tail rotor 2 of the present invention substantially improves the flight performance of the present invention, and may be advantageously combined with other features of the invention, such as engine configuration and main rotor configuration for additional benefits.

Tail Rotor Power Transmission System

The tail rotor power transmission system shown in FIG. 17 exploits the mechanical advantages of the engine configuration shown in FIG. 7, and the low operating speed and power requirements of a preferred low-power tail rotor system of the present invention. The low operating speed of tail rotor 2 results in negligible power losses in the tail rotor power transmission system.

Referring to FIG. 17, which is an exploded view of the preferred tail boom assembly of helicopter 10. Gearbox 150 is mounted at the end of aluminum tail boom 67 and encloses ball bearings 179 and 180, bevel gears 182 and 183, and tail rotor shaft 184 that together support and drive tail rotor 2. Tail rotor pinion gear 97 is appended to one end of drive wire 170 (with setscrews) and transmits rotational motion from the power train elements of helicopter 10 to drive wire 170 and thereby to tail rotor 2 attached to tail rotor hub 139.

Pinion gear 97 has plastic gear teeth molded to a hub (made from a metal such as aluminum) which can be surface-treated or shaped to securely retain the plastic teeth. Plastic bevel gear 182 is pressed or molded to the end of drive wire 170 (shown in cut-away) which can be surface-treated or shaped to retain bevel gear 182 securely. Plastic bevel gear 183 is pressed or molded to tail rotor shaft 184 which is a tube draw-formed from a material such as aluminum and which can be surface-treated or notched to securely retain bevel gear 183. Draw-forming rotor shaft 184 is very inexpensive and pressing or molding the gears to the shafts and hubs eliminates the need for mechanical fasteners, such set screws, allowing the entire gearbox assembly to be miniaturized.

Ball bearing 180 fits into circular recess 187 in one end of gearbox 150 and is retained by tail rotor hub 139 which is secured by set screws to tail rotor shaft 184.

Ball bearing 179 fits into circular recess 188 (hidden) in gearbox 150 and is retained by bearing collar 181 secured as by set screws to tail rotor shaft 184. Tail rotor hub 139 may be made entirely of metal such as aluminum, or of a plastics material such as nylon with a metallic insert to hold the threads of the set screws.

Tail boom 67 (shown in sectioned cut-away) has a center bushing 191 and end bushings 190 at each end made of a plastics material such as DELRIN (a well known brand of acetal plastic) which take the place of expensive ball bearings. Gearbox bolt 193 passes through gearbox hole 194 in gearbox 150 and bolt slot 192 near the end of tail tube 67, and into gearbox locknut 195 thereby securing gearbox 150 to tail tube 67. Bushing recesses 196 are provided in end bushings 190 to allow for passage of gearbox bolt 193.

Tail tube bracket 197 has longitudinal bracket slot 198 to allow for compression of tail tube bracket 197 around tail tube 67 when tail tube bracket 197 is mounted to the structure of helicopter 10 with tail tube bracket mounting bolts (not shown). Alternatively, tail tube bracket 197 may be constructed of two pieces for ease of manufacturability. End bushings 190 are sized diametrically to prevent the ends of tail tube 67 from collapsing when gearbox bolt 193 and tail tube bracket mounting bolts are tightened and are flanged to abut the ends of tail tube 67. While shown with a circular cross section, tail tube 67 may be a non-circular cross section such as an ellipse or airfoil shape to prevent rotation relative to gearbox 15 and tail tube bracket 197. Advantageously, gearbox 150 is made of a glueable material such as polycarbonate plastics material, so that tail fin 178 (shown in FIGS. 1 and 2) can be mounted to gearbox 150 without the use of mechanical fasteners.

Pilot control commands actuate pilot pushrod 73 (having clevis 218) and bellcrank 219. Some embodiments of the present invention utilize push-pull rod 185 to transmit control commands through the center of tail rotor shaft 184 to the tail rotor assembly attached to tail rotor hub 139, in which case tail rotor shaft 184 is necessarily hollow as shown.

Because tail rotor drive wire 170 is not connected directly to engine 3 (see FIG. 7) with a gear or belt as is common with some other model helicopters and drive wire 170 is transmitting very little engine power to the tail rotor, the side loads on drive wire 170 are very low. For this reason, inexpensive plastic bushings 190 may be used in place of ball bearings to support drive wire 170 on small model helicopters and sintered bronze bushings may be used on larger helicopters if needed. These inexpensive bushings replace several expensive ball bearing assemblies found on most other model helicopters.

Figure 18:
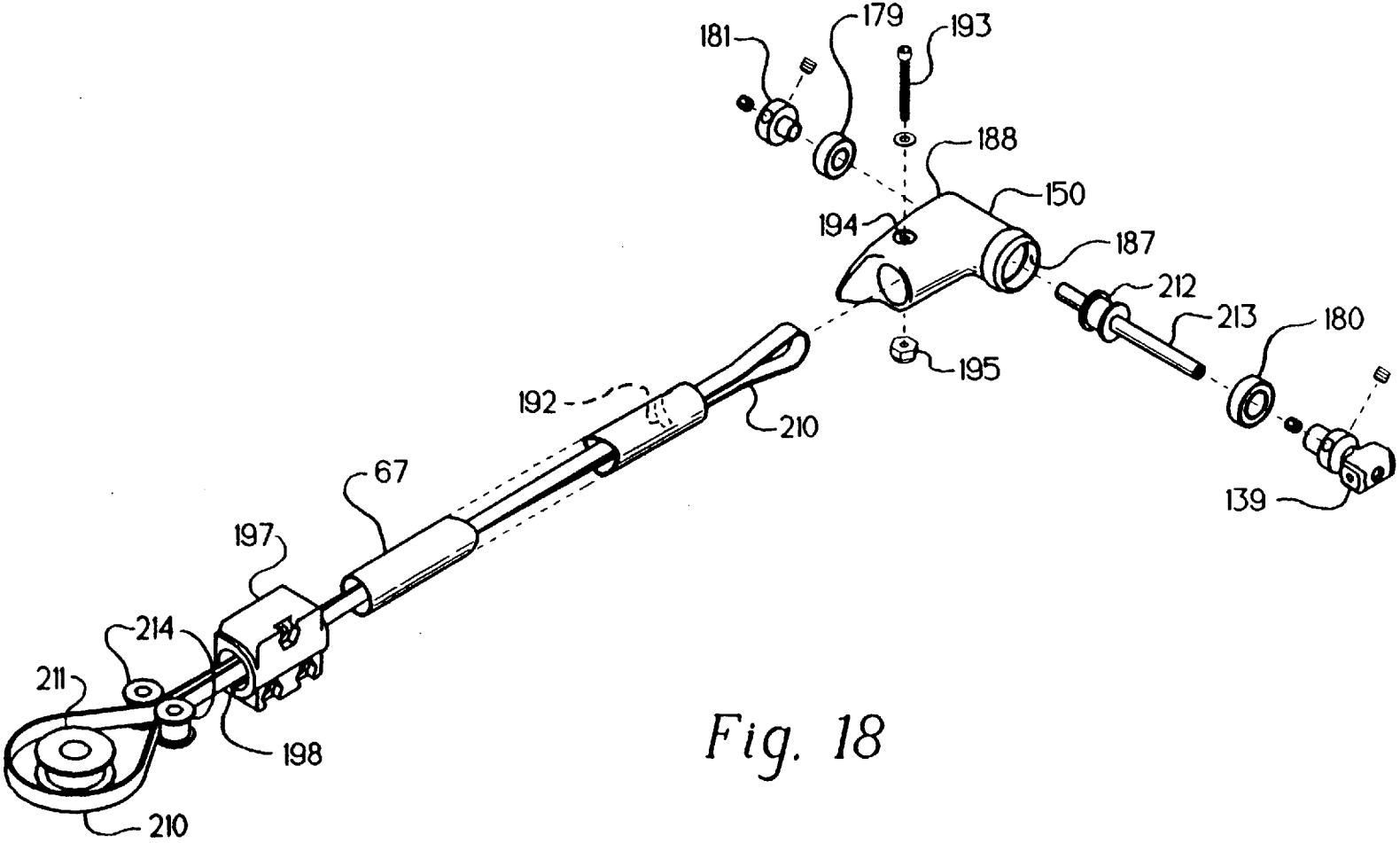
FIG. 18 is an exploded perspective view of an alternative embodiment of the tail boom and tail rotor gearbox mechanism of the model helicopter illustrated in FIG. 1 showing a simplified belt drive to the tail rotor, with the tail boom sectioned into pieces to show interior detail.

In an alternative embodiment shown in FIG. 18, the tail rotor power transmission wire-drive system of FIG. 17 may be replaced with a tail rotor power transmission belt-drive system having a toothed driving belt 210 positioned to lie in the aperture formed in tail tube 67 and configured to transmit power from front drive pulley 211 (that would replace tail rotor crown gear 96 and tail rotor pinion gear 97 shown in FIG. 7) to rear drive pulley 212 on tail rotor shaft 213. The configuration of engine 3 and main rotor shaft 93 provides substantial clearance for front drive pulley 211 and idler pulleys 214 which are provided to guide the drive belt into tail tube 67. on traditional model helicopters having tail rotor speed ratios of 4:1 to 5:1 (tail rotor:main rotor), the front drive pulley must be 4 to 5 times larger than the rear drive pulley. Large pulleys are difficult to accommodate within the fuselage of helicopter 10 and weaken the fuselage in the area around the main rotor where the structure needs to be strongest. A preferred tail rotor of the present invention operates at only 2 to 3 times the speed of the main rotor so front drive pulley 211 need only be 2 to 3 times larger in diameter than rear pulley 212 on tail rotor shaft 213. This size pulley is very easy to accommodate within the fuselage of helicopter 10. Slow speed tail rotors in accordance with the present invention not only improve flight performance, but also reduce the complexity and increase the integrity of the fuselage structure.

It will be understood from the foregoing that the tail rotor power transmission system of the present invention substantially reduces the cost, weight, and complexity of the present invention and may be advantageously combined with other features of the invention, such as the overall size of helicopter 10, the tail rotor configuration, and engine configuration for additional benefits.

Fuselage Structure

The vertical keel fuselage structure of the present invention forms the structural backbone of helicopter 10, and is designed to transmit forces vertically. Electronic and mechanical components, such as servos, ball bearing supports, and engine components are usually bolted directly to the keel, or may be mounted on risers or in trays as necessary. Impact forces as from a crash are transmitted vertically from the bottom of keel directly to each of the major mechanical assemblies of helicopter 10. This reduces the possibility of high stress in any one location on the keel and minimizes structural failures.

The present invention includes an improved fuselage having a longitudinally extending vertical keel structure. The keel supports the main rotor, tail rotor, radio control components, power transmission components, and other mechanisms necessary for the operation of the helicopter 10. The fuselage further includes a canopy support frame for supporting a canopy and landing gear supports for supporting a landing gear assembly attached to the keel.

Figure 15:
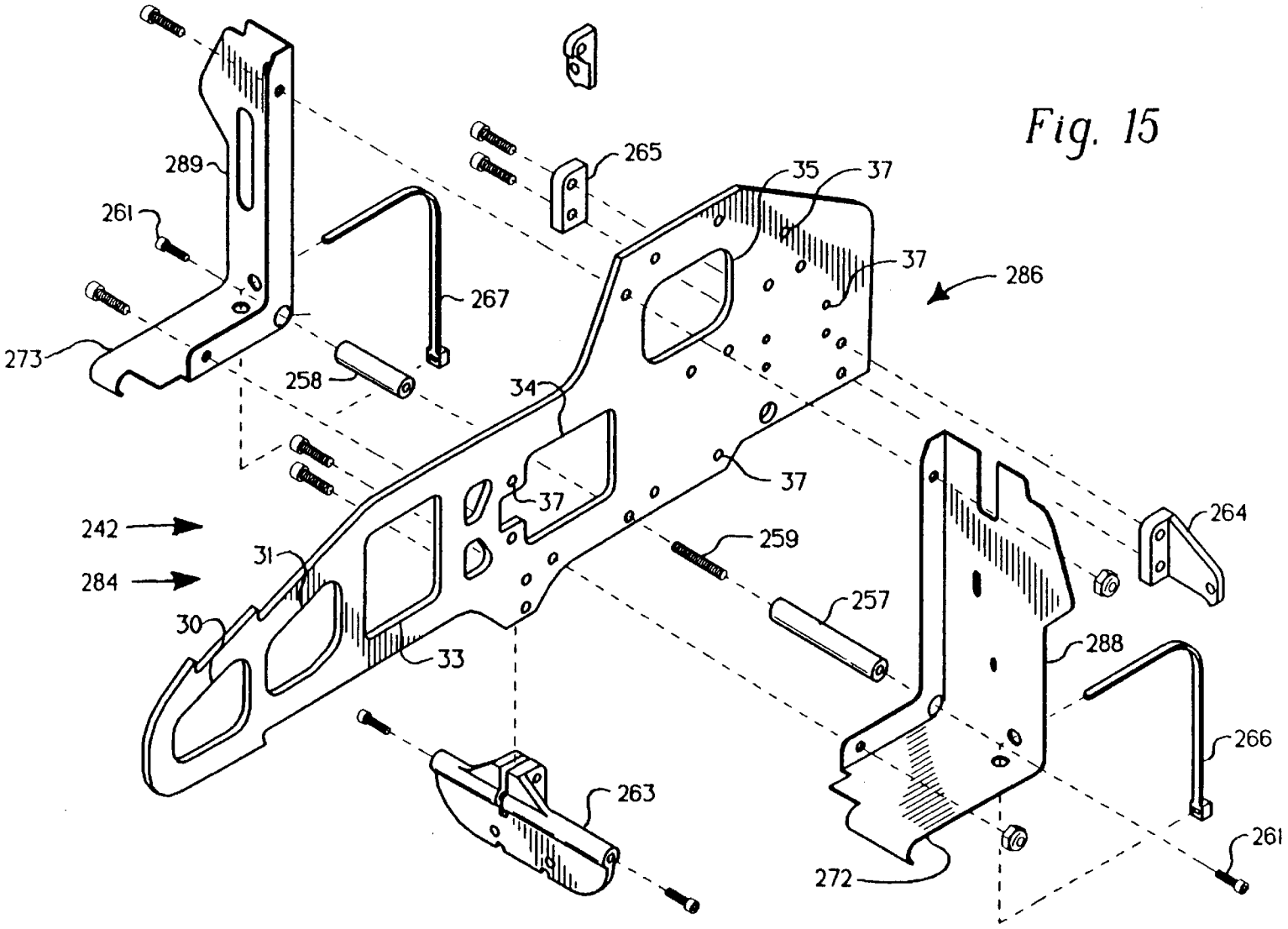
FIGS. 15 is an exploded perspective view of an alternative embodiment of a model helicopter fuselage structure in accordance with the current invention showing details of the keel, fire walls, and landing gear attachments prior to assembly.
Figure 16:
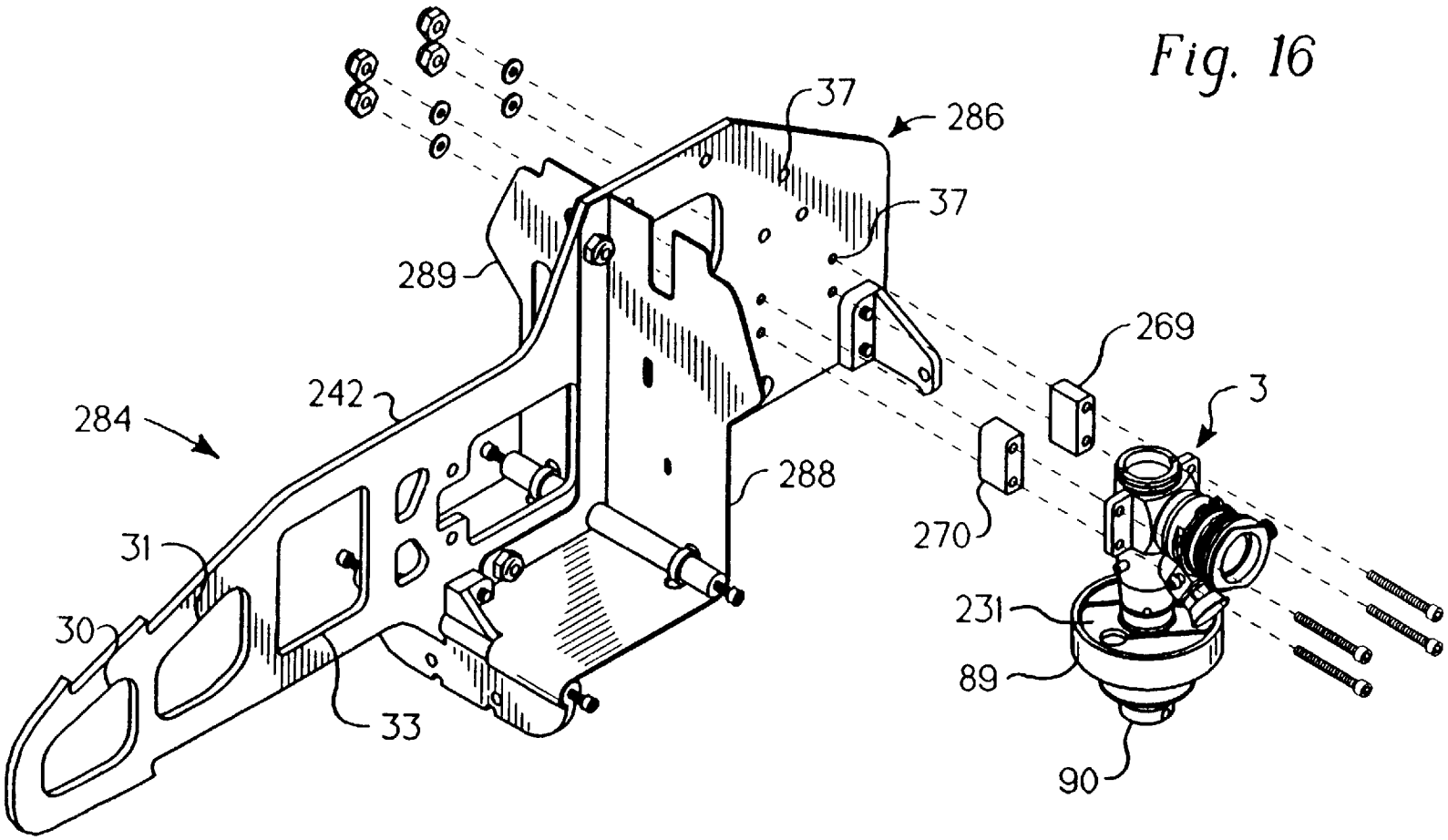
FIGS. 16 is a perspective view of an alternative embodiment of a model helicopter fuselage structure in accordance with the current invention showing details of engine installation.

As can be seen in FIGS. 15 and 16, an alternative embodiment of the present invention has vertical keel 242 with an aft end 286 and a forward end 284 separated by fire wall left half 288 and fire wall right half 289 having floor portions 272 and 273 respectively. Keel 242 is preferably die-cut in one piece from a stiff sheet material such as plywood or fiber-reinforced plastics material such as carbon-graphite sheet or G10 (glass-fiber sheet), but may also be molded from a plastics material. Keel 242 is shown spatially offset from the longitudinal centerline of helicopter 10.

Plastic canopy standoffs 257 and 258 thread onto threaded stud 259 and are thereby fixedly secured to keel 242. Bolts 261 thread into ends of standoffs 257 and 258 and support canopy 4 (shown in FIG. 1 ). Front landing gear bracket 263 and rear landing gear brackets 264 are fixedly secured to keel 242 as with bolts and are preferably injection molded of a plastics material such as polycarbonate. Left fire wall half 288 and right fire wall half 289 are illustratively vacuum formed of a plastics material such as polycarbonate, slip over ends of standoffs 257 and 258, and are secured to the keel 242 with bolts and to standoffs 257 and 258 with nylon cable ties 266 and 267.

Engine 3 is mounted to keel 242 on engine standoffs 269 and 270 so that no engine cutout is necessary in keel 242.

It will be understood from the foregoing, that the fuselage structure of the present invention substantially increases the durability, and reduces the cost and complexity of the present invention, and may be advantageously combined with other features of the invention, such as engine configuration, main rotor configuration, and radio equipment location and configuration for additional benefits.

Alternative Embodiments Many classes of radio-controlled model helicopter presently exist. There is, for instance, a 60-size class having engines with about 0.60 cubic inch displacement, and a 30-size class having engines with about 0.30 cubic inch displacement. The present invention actually represents a very valuable new class of model helicopter—the Small, Simple, Durable Class. This is a class of machines which can be understood and operated by the average hobbyist, and which can withstand repeated crashes without significant impairment of their operating qualities. No radio-controlled model helicopter ever before has been able to crash repeatedly without requiring substantial repairs.

Within the Small, Simple, Durable Class there are many effective combinations of the functional elements of the present invention which makes the class very broad. The most important operational features of this new class are durable plastic main rotor and stabilizing rotor blades, large tail rotor, passive engine cooling, and small overall physical size. Other important features include special main rotor aerodynamics, high main rotor speed, special engine and clutch configuration, and keel-type fuselage structure. It will be understood that not all of the elements will be required in every application, but each additional element will compliment and amplify the effectiveness of the others.

The unique functional elements of the invention may be advantageously applied in combination to other classes. For instance, mid-size (30-size) helicopters can advantageously employ a preferred combination of engine configuration, main rotor aerodynamics and tail rotor speed ratio for greatly increased lifting capability. They may also combine keel-type fuselage structure and plastic rotor blades for greatly increased durability in crashes.

Each of the functional elements of the present invention can substantially improve the performance of existing model helicopters. Model helicopters which have already failed in the marketplace due to high cost and relatively poor performance (such the Hirobo "MH-10", and the Kyosho "Concept 10"), can expect a new life with these improved devices. Electric helicopters (such as the Kalt "Whisper" and Kyosho "EP Concept") can expect greatly improved flight performance and durability.

Although this invention has been described in detail with reference to certain embodiments, variations and modifications exist within the scope and spirit of the invention as described and as defined in the following claims.

We claim:

1. A system for controlling the flight performance of a radio-controlled model helicopter having a power plant configured to produce power, a main rotor, and a tail rotor, wherein the main rotor is supported for rotation about a main rotor axis of rotation and driven by the power plant at a main rotor speed and the tail rotor is supported for rotation about a tail rotor axis of rotation and driven by the power plant, the system comprising a power plant cooling system for cooling the power plant, the power plant cooling system consuming less than about five percent of the power produced by the power plant and means for allocating the power produced by the power plant so that power produced by the power plant is distributed among the power plant cooling system, main rotor, and tail rotor, wherein [the power plant cooling system consumes less than about five percent of the power produced by the power plant and] the tail rotor is rotated by the power plant at a tail rotor speed of less than about three times the main rotor speed at which the main rotor is rotated by the power plant so that the tail rotor consumes a minimum amount of power produced by the power plant.

2. The system of claim 1, wherein the rotor blade is made of a flexible material.

3. The system of claim 2, wherein the flexible material is nylon.

4. The system of claim 1, wherein the drive apparatus includes a belt-drive system.

5. The system of claim 4, wherein the belt-drive system includes spaced-apart first and second pulleys and a belt engaged with the first and second pulleys, the first pulley is positioned to rotate about the main rotor axis of rotation, and the second pulley is positioned to rotate about the tail rotor axis of rotation.

6. The system of claim 5, wherein the first pulley includes a diameter and the second pulley has a diameter that is two to three times smaller than the diameter of the first pulley.

7. The system of claim 5, wherein the helicopter further includes a fuselage and a tail tube having a first end coupled to the fuselage and a second end coupled to the tail rotor, the tail tube is formed to include an aperture, and the belt is positioned to lie in the aperture formed in the tail tube.

8. The system of claim 4, wherein the drive apparatus further includes gear components configured to transfer power produced by the power plant to the main rotor and the belt-drive system.

9. The system of claim 1, wherein the drive apparatus includes gear components.

10. The system of claim 1, wherein the drive apparatus includes a main shaft having a first end coupled to the main rotor and a second end coupled to the power plant.

11. The system of claim 10, wherein the main shaft rotates about the main rotor axis of rotation.

12. The system of claim 10, wherein the drive apparatus further includes a drive wire having a first end coupled to the main shaft and a second end coupled to the tail rotor.

13. The system of claim 12, wherein the helicopter further includes a fuselage and a tail tube having a first end coupled to the fuselage and a second end coupled to the tail rotor, the tail tube is formed to include an aperture, and the drive wire is positioned to lie in the aperture formed in the tail tube.

14. The system of claim 12, wherein the drive apparatus further includes a first gear connected to the main shaft and a second gear connected to the drive wire and the first and second gears engage to transfer power from the main shaft to the drive wire.

15. A system for controlling the flight performance of a radio-controlled model helicopter having a power plant configured to produce power, a main rotor. and a tail rotor, wherein the main rotor is supported for rotation about a main rotor axis of rotation and driven by the power plant at a main rotor speed and the tail rotor is supported for rotation about a tail rotor axis of rotation and driven by the power plant the system comprising a power plant cooling system for cooling the power plant, and means for allocating the power produced by the power plant among the power plant cooling system, main rotor, and tail rotor, the power plant cooling system consuming less than about five percent of the power produced by the power plant, the tail rotor being rotated by the power plant at a tail rotor speed of less than about three times the main rotor speed at which the main rotor is rotated by the power plant so that the tail rotor consumes a minimum amount of power produced by the power plant, the main rotor including a main rotor blade extending radially from a main rotor shaft, the main rotor blade having a root portion adjacent to the main rotor shaft and a tip portion at its distal end, the root portion including a root airfoil and a root airfoil chord, the tip portion including a tip airfoil and a tip airfoil chord, and the root airfoil at the root portion including a higher degree of camber measured as a percentage of the root airfoil chord than the camber of the tip airfoil measured as a percentage of the tip airfoil chord so that the main rotor blade has greater lifting potential to use less power produced by the power plant.

16. A model rotary wing aircraft comprising a fuselage, a power plant supported by the fuselage and configured to produce power, the power plant including a passive cooling system to transfer heat produced by the power plant to the atmosphere, the passive cooling system consuming less than about five percent of the power produced by the power plant, a main rotor supported by the fuselage for rotation about a main rotor axis of rotation and driven by the power plant at a main rotor speed of rotation, a tail rotor supported by the fuselage for rotation about a tail rotor axis of rotation and driven by the power plant at a tail rotor speed of rotation, and a drive apparatus driven by the power plant, the drive apparatus extending between the power plant and the main rotor and tail rotor and transferring power from the power plant to the main rotor and tail rotor to rotate the tail rotor at a tail rotor speed of rotation that is about three times greater than the main rotor speed of rotation to minimize the amount of power used by the tail rotor.

17. The model rotary wing aircraft of claim 16, wherein the power plant operates at a power plant speed and the ratio of power plant speed to main rotor speed of rotation is about 11:1.

18. The model rotary wing aircraft of claim 16, wherein the ratio of tail rotor speed of rotation to main rotor speed of rotation is about 2:1.

19. The model rotary wing aircraft of claim 16, wherein the drive apparatus includes a belt-drive system.

20. The model rotary wing aircraft of claim 19, wherein the belt-drive system includes spaced-apart first and second pulleys and a belt engaged with the first and second pulleys, the first pulley is positioned to rotate about the main rotor axis of rotation, and the second pulley is positioned to rotate about the tail rotor axis of rotation.

21. The model rotary wing aircraft of claim 20, wherein the first pulley has a diameter and the second pulley has a diameter that is two to three times smaller than the diameter of the first pulley.

22. The model rotary wing aircraft of claim 20, wherein the helicopter further includes a fuselage and a tail tube having a first end coupled to the fuselage and a second end coupled to the tail rotor, the tail tube is formed to include an aperture, and the belt is positioned to lie in the aperture formed in the tail tube.

23. The model rotary wing aircraft of claim 16, wherein the drive apparatus includes gear components.

24. The model rotary wing aircraft of claim 16, wherein the drive apparatus includes a main shaft having a first end coupled to the main rotor and a second end coupled to the power plant.

25. The model rotary wing aircraft of claim 24, wherein the main shaft rotates about the main rotor axis of rotation.

26. The model rotary wing aircraft of claim 24, wherein the drive apparatus further includes drive wire having a first end coupled to the main shaft and a second end coupled to the tail rotor.

27. The model rotary wing aircraft of claim 19, wherein the drive apparatus further includes gear components configured to transfer power produced by the power plant to the main rotor and the belt-drive system.

28. The model rotary wing aircraft of claim 26, wherein the helicopter further includes a fuselage and a tail tube having a first end coupled to the fuselage and a second end coupled to the tail rotor, the tail tube is formed to include an aperture, and the drive wire is positioned to lie in the aperture formed in the tail tube.

29. The model rotary wing aircraft of claim 26, wherein the drive apparatus further includes a first gear connected to the main shaft and a second gear connected to the drive wire and the first and second gears engage to transfer power from the main shaft to the drive wire.

30. A method of operating a model helicopter, the method comprising the steps of providing a model helicopter having a power plant configured to produce power, a main rotor, a tail rotor, a power plant cooling system configured to cool the power plant, and a drive apparatus connecting the power plant to the main rotor and tail rotor, the main rotor being supported for rotation about a main rotor axis of rotation and driven by the power plant at a main rotor speed, and the tail rotor being supported for rotation about a tail rotor axis of rotation and driven by the power plant, operating the power plant cooling system with expenditure of no more than about five percent of the power produced by the power plant, rotating the main rotor at a main rotor speed using the drive apparatus, and rotating the tail rotor at a tail rotor speed using the drive apparatus, the tail rotor speed being less than about three times the main rotor speed.

31. The method of claim 30, wherein the step of rotating the tail rotor includes rotating the tail rotor at a tail rotor speed of about 2.1 times the main rotor speed during normal operation of the helicopter in flight.

32. The method of claim 30, wherein the step of rotating the main rotor includes rotating the main rotor above about 1600 revolutions per minute during normal operation of the helicopter in flight.

33. The method of claim 30, further comprising the steps of providing an output shaft on the power plant that is connected to the main rotor and rotating the output shaft at an output shaft speed of about eleven times the main rotor speed during normal operation of the helicopter in flight.

34. The model rotary wing aircraft of claim 16, wherein the main rotor includes a plurality of main rotor blades having a main rotor diameter, the tail rotor includes a plurality of tail rotor blades having a tail rotor diameter, and the main rotor diameter is about three to four times greater than the tail rotor diameter.

35. The model rotary wing aircraft of claim 34, wherein the main rotor diameter is about 3.2 times greater than the tail rotor diameter.

36. The model rotary wing aircraft of claim 16 further comprising drive train components that connect the power plant and main rotor, about ten percent of the power produced by the power plant is consumed by the tail rotor, and about ninety percent of the power produced by the power plant is consumed by the main rotor and drive train components.

37. The model rotary wing aircraft of claim 16, wherein the passive cooling system is a heat sink.

38. The model rotary wing aircraft of claim 16, wherein the main rotor system includes a pair of main rotor blades made of a plastics material.

39. The model rotary wing aircraft of claim 16, wherein the tail rotor system includes a pair of tail rotor blades made of a plastics material.

40. The model rotary wing aircraft of claim 16, wherein the fuselage includes a single flat keel.

41. The model rotary wing aircraft of claim 16, wherein the power plant is an internal combustion engine.

42. The model rotary wing aircraft of claim 16, wherein the passive cooling system includes a plurality of cooling fins, each of the cooling fins includes a fin surface area, and the fin surface areas of the plurality of cooling fins are sufficient to conduct heat produced by the engine into the atmosphere without expenditure of power produced by the power plant.

43. A model rotary wing aircraft comprising a fuselage, a power plant supported by the fuselage and configured to produce power, the power plant including a passive cooling system to transfer heat produced by the power plant to the atmosphere, the passive cooling system consuming less than about five percent of the power produced by the power plant, a main rotor supported by the fuselage for rotation about a main rotor axis of rotation and driven by the power plant at a main rotor speed of rotation, the main rotor including a plurality of main rotor blades having a main rotor diameter, and a tail rotor supported by the fuselage for rotation about a tail rotor axis of rotation and driven by the power plant at a tail rotor speed of rotation, the tail rotor including a plurality of tail rotor blades having a tail rotor diameter, and the main rotor diameter being about three to four times greater than the tail rotor diameter to minimize the amount of power used by the tail rotor.

44. The model rotary wing aircraft of claim 43, wherein the tail rotor speed of rotation is about three times less than the main rotor speed of rotation to minimize the amount of power used by the tail rotor.

45. The model rotary wing aircraft of claim 43, wherein the main rotor diameter is about 3.2 times greater than the tail rotor diameter.

46. The system of claim 1, wherein the power plant has a cooling surface area configured to conduct heat from the power plant into the atmosphere surrounding the power plant, the power plant cooling system includes a heat sink having a heat sink surface area configured to conduct heat from the heat sink into the atmosphere surrounding the heat sink, and the heat sink is coupled to the power plant to increase the amount of heat transferred from the power plant to the surrounding atmosphere so that the cooling system consumes essentially none of the power produced by the power plant.

47. The system of claim 1, wherein the tail rotor speed is about 2.1 times the main rotor speed during normal operation of the helicopter in flight.

48. The system of claim 1, wherein the power plant further includes an output shaft connected to the main rotor and the output shaft rotates at a speed of about eleven times the main rotor speed during normal operation of the helicopter in flight.

49. The system of claim 1, wherein the main rotor is stated by the power plant at a high speed above about 1600 revolutions per minute during normal operation of the helicopter in flight.

50. A method of operating a model helicopter, the method comprising the steps of providing a model helicopter having a power plant configured to produce power, a main rotor, a tail rotor, a power plant cooling system configured to cool the power plant, and a drive apparatus connecting the power plant to the main rotor and tail rotor, the main rotor being supported for rotation about a main rotor axis of rotation and driven by the power plant at a main rotor speed, and the tail rotor being supported for rotation about a tail rotor axis of rotation and driven by the power plant, operating the power plant cooling system with expenditure of no more than about five percent of the power produced by the power plant, and operating the drive apparatus to rotate the main rotor at a main rotor speed and to rotate the tail rotor at a tail rotor speed that is less than about three times the main rotor speed.

* * * * *